US007775448B2

(12) United States Patent
Votaw et al.

(10) Patent No.: US 7,775,448 B2
(45) **Date of Patent: *Aug. 17, 2010**

(54) SYSTEM AND METHOD FOR HEAT PUMP ORIENTED ZONE CONTROL

(75) Inventors: Mark Votaw, North Canton, OH (US); Joseph Ramunni, Wadsworth, OH (US); Thomas Delp, Aurora, OH (US); Dennis Laughlin, Chardon, OH (US); Al Zelczer, University Heights, OH (US); Leonard Roth, University Heights, OH (US); Vladimir Sipershteyn, Independence, OH (US)

(73) Assignee: Arzel Zoning Technology, Inc., Cleveland, OH (US)

( * ) Notice: Subject to any disclaimer, the term of this patent is extended or adjusted under 35 U.S.C. 154(b) by 468 days.

This patent is subject to a terminal disclaimer.

(21) Appl. No.: 11/226,165

(22) Filed: Sep. 14, 2005

(65) Prior Publication Data

US 2007/0057075 A1 Mar. 15, 2007

(51) Int. Cl.

| | |
|---|---|
| ***F24D 19/10*** | (2006.01) |
| ***G05D 23/275*** | (2006.01) |
| ***B60H 1/00*** | (2006.01) |
| ***B60H 1/03*** | (2006.01) |

(52) U.S. Cl. ..... 236/1 B; 237/2 A

(58) Field of Classification Search ..... 62/176.1, 62/176.3, 176.6, 229; 236/44 C, 44 R, 44 A, 236/91 E, 1 B; 237/2 A See application file for complete search history.

(56) References Cited

U.S. PATENT DOCUMENTS

| | | | | |
|---|---|---|---|---|
| 2,254,185 A | | 8/1941 | Newton | |
| 4,261,509 A | | 4/1981 | Anders et al. | |
| 4,265,299 A | | 5/1981 | Harnish | |
| 4,324,288 A | | 4/1982 | Karns | |
| 4,487,028 A | * | 12/1984 | Foye | 62/115 |
| 4,501,125 A | | 2/1985 | Han | |
| 4,530,395 A | | 7/1985 | Parker et al. | |
| 5,197,293 A | * | 3/1993 | Okamura et al. | 62/228.4 |
| 5,245,835 A | | 9/1993 | Cohen et al. | |
| 5,297,396 A | * | 3/1994 | Kitamoto | 62/175 |

(Continued)

FOREIGN PATENT DOCUMENTS

DE 3016125 A * 11/1981

OTHER PUBLICATIONS

International Search Report for PCT application No. PCT/US07/77500 mailed Apr. 7, 2008.

(Continued)

*Primary Examiner*—Chen-Wen Jiang
(74) *Attorney, Agent, or Firm*—Hahn Loeser & Parks LLP

(57) ABSTRACT

A system and method to control environmental parameters of pre-defined zones within an environment using an electronic controller are disclosed. The system includes an electronic controller which enables a weighting value to be assigned to each zone within the environment. The electronic controller also detects any zone service calls from sensor devices associated with each of the zones and determines a cumulative weighting value in response to the detected zone service calls. The electronic controller selects a staging combination from at least two possible staging combinations in response to at least the cumulative zone weighting value.

16 Claims, 37 Drawing Sheets

U.S. PATENT DOCUMENTS

| | | | | |
|---|---|---|---|---|
| 5,348,078 | A * | 9/1994 | Dushane et al. | 165/209 |
| 5,488,218 | A * | 1/1996 | Olsen et al. | 219/492 |
| 5,701,750 | A * | 12/1997 | Ray | 62/160 |
| 5,829,674 | A | 11/1998 | Vanostrand et al. | |
| 5,979,167 | A * | 11/1999 | Kochavi et al. | 62/186 |
| 6,786,473 | B1 | 9/2004 | Alles | |
| 6,865,449 | B2 | 3/2005 | Dudley | |
| 6,997,390 | B2 | 2/2006 | Alles | |
| 7,062,830 | B2 | 6/2006 | Alles | |
| 2004/0194484 | A1 * | 10/2004 | Zou et al. | 62/186 |
| 2005/0064812 | A1 | 3/2005 | Darling | |
| 2005/0116055 | A1 | 6/2005 | Alles | |
| 2005/0156050 | A1 | 7/2005 | Shah et al. | |
| 2005/0234597 | A1 * | 10/2005 | Harrod et al. | 700/276 |
| 2007/0063059 | A1 * | 3/2007 | Votaw et al. | 236/1 B |

OTHER PUBLICATIONS

Written Opinion for PCT application No. PCT/US07/77500 mailed Apr. 7, 2008.

* cited by examiner

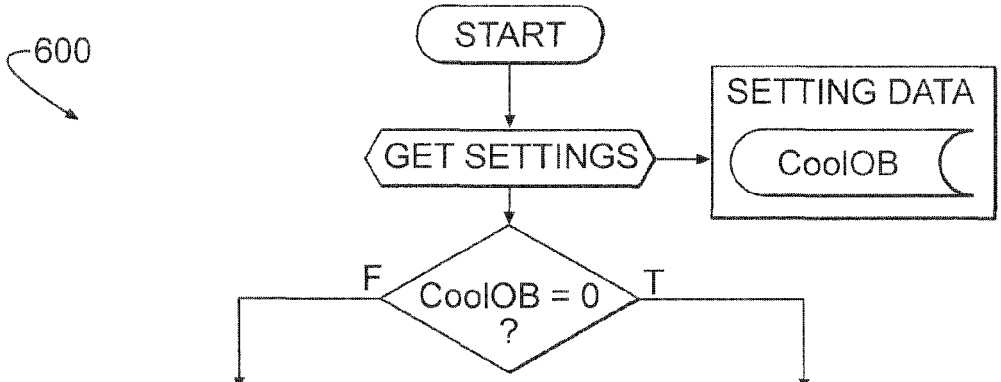

| THERMO-STAT INPUTS | TRANSLATIONS | HVAC OUTPUT |
|---|---|---|
| O | COOLING MODE | B |
| G | FAN ONLY | G |
| GO | FAN ONLY IN COOLING MODE | G,B |
| Y1,G | HEATING | Y1,G |
| Y1,G,O | COOLING | Y1,G,B |
| Y1,Y2,G | 2 STAGE HEATING | Y1,Y2,G |
| Y1,Y2,G,O | 2 STAGE COOLING | Y1,Y2,G,B |
| W1,Y1,G | 1 STG HP HEAT W/ BACKUP ELECTRIC HEAT | W,Y1,G |
| W1,Y1, Y2,G | 2 STG HP HEAT W/ BACKUP RESISTANCE HEAT | W1,Y1, Y2,G |
| W1,W2Y1, Y2,G | 2 STAGE HP HEAT W/ 2 STG BACKUP RESISTANCE HEAT | W1,W2, Y1,Y2,G |
| W1 | FFUEL HEAT CALL | W1 |
| W1,G | FFUEL HEAT CALL W/ FAN | W1,G |
| W1,W2 | 2 STG FFUEL HEAT CALL | W1,W2 |
| W1,W2,G | 2 STG FFUEL HEAT CALL W/ FAN | W1,W2,G |
| E | EMERGENCY HEAT FLAG | E |
| D | DEHUMIDIFICATION | D |
| H | HUMIDIFICATION | H |

| THERMO-STAT INPUTS | TRANSLATIONS | HVAC OUTPUT |
|---|---|---|
| O | COOLING MODE | N/A |
| G | FAN ONLY | G |
| GO | FAN ONLY IN COOLING MODE | G |
| Y1,G | HEATING | Y1,G |
| Y1,G,O | COOLING | Y1,G,O |
| Y1,Y2,G | 2 STAGE HEATING | Y1,Y2,G |
| Y1,Y2,G,O | 2 STAGE COOLING | Y1,Y2,G,O |
| W1,Y1,G | 1 STG HP HEAT W/ BACKUP ELECTRIC HEAT | W,Y1,G |
| W1,Y1, Y2,G | 2 STG HP HEAT W/ BACKUP RESISTANCE HEAT | W1,Y1, Y2,G |
| W1,W2Y1, Y2,G | 2 STAGE HP HEAT W/ 2 STG BACKUP RESISTANCE HEAT | W1,W2, Y1,Y2,G |
| W1 | FFUEL HEAT CALL | W1 |
| W1,G | FFUEL HEAT CALL W/ FAN | W1,G |
| W1,W2 | 2 STG FFUEL HEAT CALL | W1,W2 |
| W1,W2,G | 2 STG FFUEL HEAT CALL W/ FAN | W1,W2,G |
| E | EMERGENCY HEAT FLAG | E |
| D | DEHUMIDIFICATION | D |
| H | HUMIDIFICATION | H |

| VARIABLE | DESCRIPTION | SOURCE |
|---|---|---|
| CoolOB | SETS THE REVERSING VALVE OUTPUT FOR THE TYPE OF HVAC EQUIPMENT BEING USED | Set Wiz |

FIG. 6

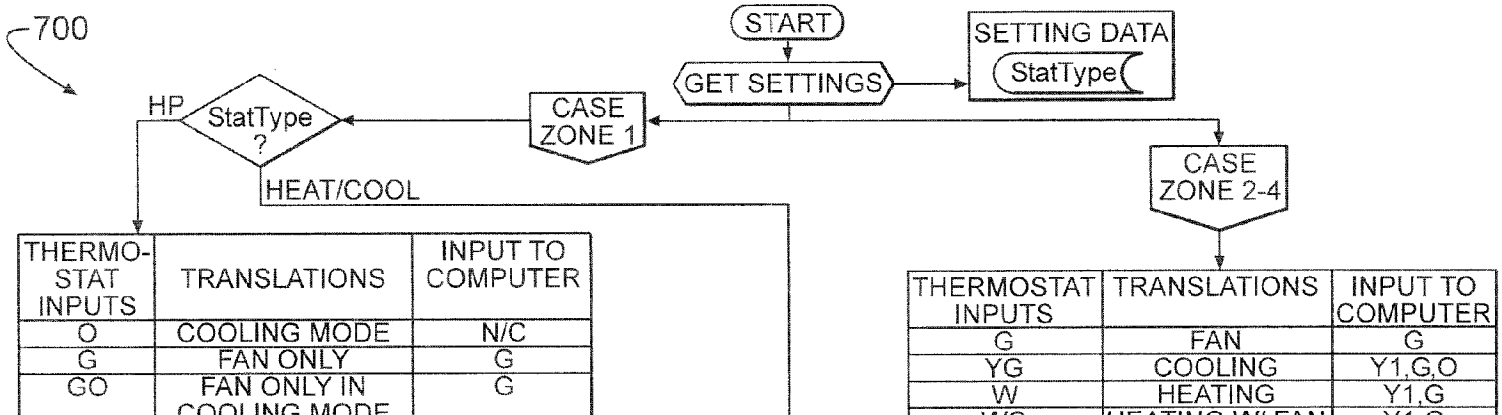

| THERMO-STAT INPUTS | TRANSLATIONS | INPUT TO COMPUTER |
|---|---|---|
| O | COOLING MODE | N/C |
| G | FAN ONLY | G |
| GO | FAN ONLY IN COOLING MODE | G |
| Y1,G | HEATING | Y1,G |
| Y1,G,O | COOLING | Y1,G,O |
| Y1,Y2,G | 2 STAGE HEATING | Y1,Y2,G |
| Y1,Y2,G,O | 2 STAGE COOLING | Y1,Y2,G,O |
| W1,Y1,G | 1 STG HP HEAT W/ BACKUP ELECTRIC HEAT | W,Y1,G |
| W1,Y1, Y2,G | 2 STG HP HEAT W/ BACKUP RESISTANCE HEAT | W1,Y1, Y2,G |
| W1,W2Y1, Y2,G | 2 STAGE HP HEAT W/ 2 STG BACKUP RESISTANCE HEAT | W1,W2, Y1,Y2,G |
| W1 | FFUEL HEAT CALL | W1 |
| W1,G | FFUEL HEAT CALL W/ FAN | W1,G |
| W1,W2 | 2 STG FFUEL HEAT CALL | W1,W2 |
| W1,W2,G | 2 STG FFUEL HEAT CALL W/ FAN | W1,W2,G |
| E | EMERGENCY HEAT FLAG | E |
| D | DEHUMIDIFICATION | D |
| H | HUMIDIFICATION | H |

| THERMOSTAT INPUTS | TRANSLATIONS | INPUT TO COMPUTER |
|---|---|---|
| G | FAN | G |
| YG | COOLING | Y1,G,O |
| W | HEATING | Y1,G |
| WG | HEATING W/ FAN | Y1,G |

| THERMOSTAT INPUTS | TRANSLATIONS | INPUT TO COMPUTER |
|---|---|---|
| G | FAN | G |
| Y1G | COOLING | Y1,G,O |
| Y1,Y2,G | 2 STAGE COOL | Y1,Y2,G,O |
| W1 | HEATING | Y1,G |
| W1,G | HEATING W/ FAN | Y1,G |
| W1,W2 | 2 STAGE HEATING | Y1,Y2,G |
| W1,W2,G | 2 STAGE HEATING W/ FAN | Y1,Y2,G |
| D | DEHUMIDIFICATION | D |
| H | HUMIDIFICATION | H |

| VARIABLE | DESCRIPTION | SOURCE |
|---|---|---|
| StatType | DETERMINES WHAT SIGNALS PROGRAM LOOKS FOR FROM ZONE 1 THERMOSTAT | Set Wiz |

FIG. 7

ZONE1 STAT TYPE?
HEAT PUMP
HEAT/COOL

ZONE1 RELATIVEWEIGHT
10% 40% 70%
20% 50% 80%
30% 60% 90%

ZONE2 RELATIVEWEIGHT
10% 40% 70%
20% 50% 80%
30% 60% 90%

ZONE3 RELATIVEWEIGHT
10% 40% 70%
20% 50% 80%
30% 60% 90%

ZONE4 RELATIVEWEIGHT
10% 40% 70%
20% 50% 80%
30% 60% 90%

STAGING THRESHOLD
60%

INCREMENT/DECREMENT BY 10% INTERVALS

FARENHIEGHT OR
CELSIUS
F
C

FIG. 8A

MIN HEAT TEMP
90 DEGREES

INCREMENT/DECREMENT BY 1 DEGREE INCREMENTS

MAX COOLING TEMP
50DEGREES

INCREMENT/DECREMENT BY 1 DEGREE INCREMENTS

BALLANCE POINT
25DEGREES

INCREMENT/DECREMENT BY 1 DEGREE INCREMENTS

OUTDOOR RESET TEMP
30DEGREES

INCREMENT/DECREMENT BY 1 DEGREE INCREMENTS

LEAVING AIR TEMP
HIGH LIMIT
110DEGREES

INCREMENT/DECREMENT BY 1 DEGREE INCREMENTS

LEAVING AIR TEMP
LOW LIMIT
42DEGREES

INCREMENT/DECREMENT BY 1 DEGREE INCREMENTS

LEAVING AIR TEMP
HIGH LIMIT-BACKUP
140DEGREES

INCREMENT/DECREMENT BY 1 DEGREE INCREMENTS

FIG. 8B

```
BACKUP HEAT SOURCE
 ELECTRIC
 GAS
```

```
FURNACE CTRL FAN?
  YES
  NO
```

```
DEHUMIDIFICATION
  SIGNAL
   24VAC
    0VAC
```

```
END-OF-CYLE TIME
  90 SECONDS
```

INCREMENT/DECREMENT IN 10 SECOND INTERVALS

```
DEHUMIDIFCATION
CYCLE TIME
   10MINUTE
```

INCREMENT/DECREMENT IN 5-MINUTE INTERVALS

900

1000

| VARIABLE NAME | DESCRIPTION | SOURCE |
|---|---|---|
| HpEccDelay | TIME TO HOLD DAMPERS IN POSITION AFTER HP CALL | SetWiz |
| FfEccDelay | TIME TO HOLD DAMPERS IN POSITION AFTER FF CALL | SetWiz |
| End Cycle | # OF MINS DELAY END OF CYCLE TIME | SetWiz |

| VARIABLE NAME | DESCRIPTION | SOURCE |
|---|---|---|
| HpEccDelay | TIME TO HOLD DAMPERS IN POSITION AFTER HP CALL | SetWiz |
| FfEccDelay | TIME TO HOLD DAMPERS IN POSITION AFTER FF CALL | SetWiz |
| End Cycle | # OF MINS DELAY END OF CYCLE TIME | SetWiz |

| VARIABLE | DESCRIPTION | SOURCE |
|---|---|---|
| HeatLAT | LOW LEAVING AIR TEMPERATURE LIMIT | SetWiz |
| CoolOB | DEFINES HEATING AND COOLING MODE | SetWiz |
| BkypType | DEFINES BACKUP Ht TYPE | SetWiz |
| FFHTLAT | HIGH LAT LIMIT FOR FOSSIL FUEL FURNACE | SetWiz |

| DEGREES F | |
|---|---|
| OAT | MinHeatAdjustment |
| 60 | -6 |
| 55 | -4 |
| 50 | -2 |
| 45 | 0 |
| 40 | 0 |
| 35 | +2 |
| 30 | +2 |
| 25 | +4 |
| 20 | +4 |
| 15 | +5 |
| 10 | +7 |
| 5 | +7 |
| 0 | +10 |
| -5 | +10 |
| -10 | +15 |
| -15 | +15 |
| -20 | +20 |
| -25 | +20 |
| -30 | +20 |

| VARIABLE | DESCRIPTION | SOURCE |
|---|---|---|
| OutReset | OUTDOOR RESET TEMPERATURE | SetWiz |

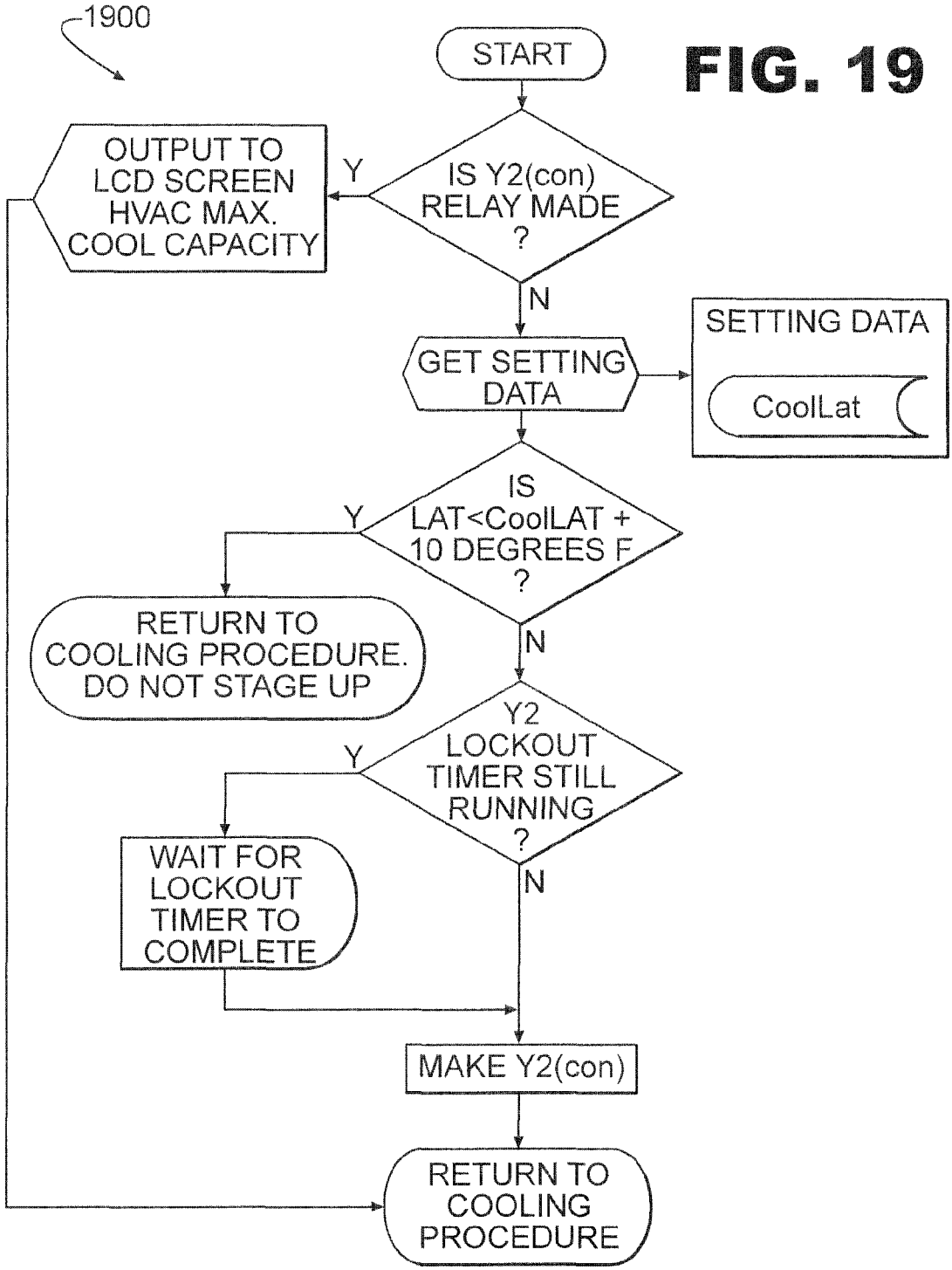
| VARIABLE | DESCRIPTION | SOURCE |
|---|---|---|
| CoolLat | LOW LIMIT FOR LEAVING AIR CONTROL | SetWiz |

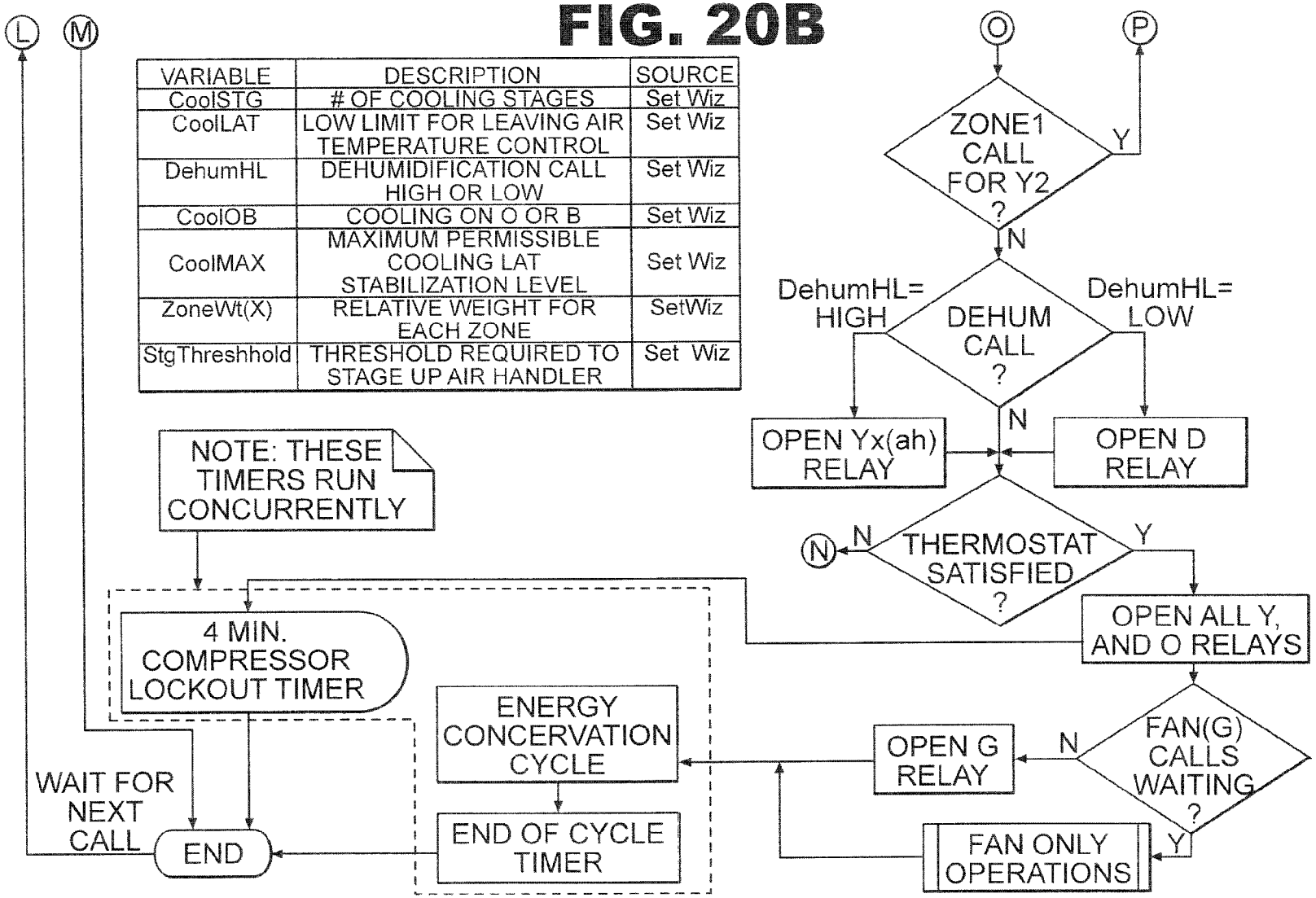

FIG. 20B

| VARIABLE | DESCRIPTION | SOURCE |
|---|---|---|
| CoolSTG | # OF COOLING STAGES | Set Wiz |
| CoolLAT | LOW LIMIT FOR LEAVING AIR TEMPERATURE CONTROL | Set Wiz |
| DehumHL | DEHUMIDIFICATION CALL HIGH OR LOW | Set Wiz |
| CoolOB | COOLING ON O OR B | Set Wiz |
| CoolMAX | MAXIMUM PERMISSIBLE COOLING LAT STABILIZATION LEVEL | Set Wiz |
| ZoneWt(X) | RELATIVE WEIGHT FOR EACH ZONE | SetWiz |
| StgThreshhold | THRESHOLD REQUIRED TO STAGE UP AIR HANDLER | Set Wiz |

| VARIABLE | DESCRIPTION | SOURCE |
|---|---|---|
| CoolLAT | LOW LIMIT AIR TEMPERATURE LIMIT | Set Wiz |
| CoolOB | DEFINES CONDITION OR O/B FOR A COOLING CALL | Set Wiz |

2300
HEATING PROCEDURE START
THERMOSTAT(S) CALL FOR HEAT
PRIORITY SUBROUTINE RETURNS HEATING
GET DATA
RESET TEMP TO CALCULATE MinHeat
SETTING DATA
BackSource
HeatLat
MinHeat
BallancePT
ResetTemp
ZoneWt(X)
StgThreshold
BackSource ?
FFUEL
OAT< BallancePT ?
Y
N
ELECTRIC
MAKE W1 RELAY
MAKE Y1(ah), Y1(con), G RELAYS
IS SUM OF ZoneWtX > StgThreshold ?
Y
N
CLOSE Y2(AH) RELAY
R
S
T
U
V

FIG. 23C

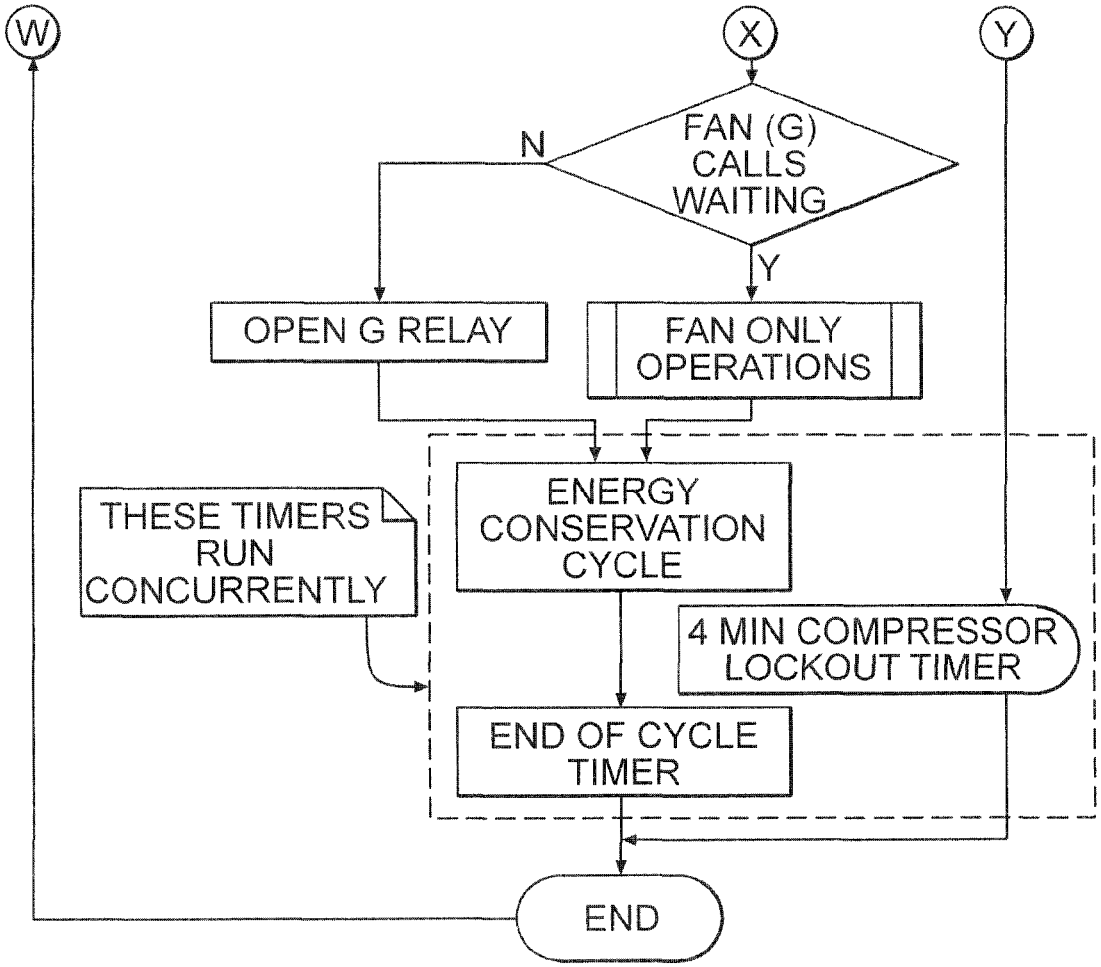

| VARIABLE | DESCRIPTION | SOURCE |
|---|---|---|
| BackSource | BACKUP HEAT SOURCE ELECTRIC HI STRIP ON FF FURNACE | SetWiz |
| MinHeat | MINIMUM HEATING STABILIZATION PT | SetWiz |
| ResetTemp | MODIFIES MIN HEAT FOR OAT | SetWiz |
| HeatLat | HIGH LIMIT FOR LEAVING AIR CONTROL | SetWiz |
| BalancePT | OAT WHERE HEAT PUMP LOCKED OUT AND FF FURNACE IS PRIMARY | SetWiz |
| ZoneW(X) | THE RELATIVE WEIGHT OF EACH ZONE (X=1 TO 4) | SetWiz |
| StgThreshold | THE THRESHOLD REQUIRED TO STAGE UP AIR HANDLER | SetWiz |

| VARIABLE | DESCRIPTION | SOURCE |
|---|---|---|
| BallancePt | ECONOMIC BALANCE Pt | Set Wiz |
| HeatLat | HIGH LIMIT FOR LEAVING AIR CONTROL | Set Wiz |
| BackSource | BACKUP HEAT SOURCE | Set Wiz |

SYSTEM AND METHOD FOR HEAT PUMP ORIENTED ZONE CONTROL

TECHNICAL FIELD

Certain embodiments of the present invention relate to zoned control of an environment. More particularly, certain embodiments of the present invention relate to a system and method to control environmental parameters of pre-defined zones within an environment using an electronic controller and weighted zones.

BACKGROUND OF THE INVENTION

The cooling and heating of commercial buildings and residential homes is typically accomplished via forced air and forced hot or cooled water distribution systems. A furnace, heat pump, other fossil fuel furnace, and/or air conditioner are typically used to supply heated air or cooled air to areas of the building or home via ducts. Such distribution systems are often controlled by a single thermostat which is centrally located within the building or home. A person sets the thermostat to a particular temperature setting. When the temperature measured by the thermostat deviates a pre-defined amount from the set temperature, a furnace, heat pump, other fossil fuel furnace, or air conditioner is turned on to provide heated or cooled air to the various regions of the building or home via the duct work or water lines.

Even though the desired temperature may be achieved at the location of the thermostat, the resultant temperatures in the various other regions of the building or home may still deviate quite a bit from this desired temperature. Therefore, a single centrally located thermostat likely will not provide adequate temperature control for individual rooms and areas. In an attempt to address this problem, duct work and valves throughout the building or home are fitted with manually adjustable registers or dampers which help to control the flow of air to the various regions. The dampers and valves are typically each adjusted to a single position and left in that state. Such an adjustment may be fine for a particular time of year, outside temperature level, and humidity level, but is likely not optimal for most other times of the year and other temperature and humidity levels. Furthermore, such an adjustment may only be fine for a particular time of day due to the internal and external daily load variances that occur depending on, for example, the position of the sun, whether or not lights are on, and how many people are in a particular area. It is often time consuming and difficult to re-adjust the dampers and valves for optimal comfort level.

The industry has developed multi-zone control systems in an attempt to better control the environmental parameters in each room or region of a home or building, for example, by placing thermostats in each larger room or groups of rooms. However, such systems to date have not been flexible enough to be entirely successful. For example, if a thermostat in a first room calls for heat, a furnace may be turned on to provide the heat. However, some of this heat may still be getting distributed to other rooms which do not presently require heat. As a result, these other rooms may become uncomfortably warm. Having multiple furnaces, air conditioners, and/or heat pumps which are connected to different thermostats and service only certain rooms may help this problem, however, this tends to be an expensive solution due to the extra equipment required and resulting service charges.

Heat pumps are relatively inexpensive to operate and can both heat air and cool air. Heat pumps use a refrigeration system to cool air and use the same refrigeration system run in reverse to heat air. Environmental control of several zones via heat pumps typically calls for a separate heat pump and thermostat for each zone or installation of a multi-zone system as previously described.

In view of the foregoing discussion, it is apparent that there is a need for a more efficient way of controlling the distribution of air and environmental parameters for several zones in a building or home.

Further limitations and disadvantages of conventional, traditional, and proposed approaches will become apparent to one of skill in the art, through comparison of such systems and methods with the present invention as set forth in the remainder of the present application with reference to the drawings.

SUMMARY OF THE INVENTION

An embodiment of the present invention comprises a method to control environmental parameters of pre-defined zones within a first environment using an electronic controller. The method comprises assigning a weighting value to each of the pre-defined zones within the environment using the electronic controller. The method also comprises detecting any zone service calls from sensor devices associated with each of the pre-defined zones using the electronic controller. The method further comprises determining a cumulative zone weighting value in response to the detected zone service calls using the electronic controller and selecting a staging combination from at least two possible staging combinations in response to at least the cumulative zone weighting value using the electronic controller.

A further embodiment of the present invention comprises a system to control environmental parameters of pre-defined zones within a first environment. The system includes an electronic controller, wherein the electronic controller associates an assigned weighting value to each of the pre-defined zones within the environment; detects any zone service calls from sensor devices associated with each of the pre-defined zones; determines a cumulative zone weighting value in response to the sensed zone service calls; and selects a staging combination from at least two possible staging combinations in response to at least the cumulative zone weighting value.

In accordance with an embodiment of the present invention, an electronic controller has been designed to optimize the operation of heating and air conditioning equipment. The electronic controller refines control of the equipment by bringing on only specific subsystems of the heating and cooling equipment, depending on the demand from the environmental sensors, the outside air temperature, the temperature of the air leaving the equipment, and the electric utility efficiency programs. The electronic controller allows the available airflow to be concentrated to the areas where there is a current demand for heating, cooling, or ventilation by controlling a set of air-driven zone dampers.

Embodiments of the present invention provide the ability to choose between more distinct operating modes for the heating and cooling equipment than has typically been contemplated in the past. Embodiments of the present invention provide algorithms to incorporate humidification and dehumidification equipment and techniques that have not typically been a part of a zoning system.

In accordance with an embodiment of the present invention, a plain English "setup wizard" is provided as part of the controller which allows HVAC installers to configure the system quickly and easily for any system. That is, the controller is a non-proprietary controller that is designed to be configured for and useable with any standard forced air system. In accordance with an embodiment of the present invention, simple and inexpensive standard heat/cool thermostats are used on predefined zones 2 through 4 to make installation easier (e.g., single stage thermostats). Zones 2-4, using simple thermostats, depend more on the controller for zone control. That is, the simple single stage thermostats can only tell the controller if its zone needs heating or cooling. The simple thermostats cannot tell the controller how much heating or cooling is needed or that a zone still needs more heating or cooling. Embodiments of the present invention allow installers to use any thermostat, either heat pump or heat/cool on a predefined zone 1 (e.g., a smarter more complex multi-stage thermostat with emergency or auxiliary heat capability, or a simple thermostat as used on zones 2-4). As a result, the installer is able to take advantage of certain advanced features built into today's modern thermostats. Installers may also use wireless, auto changeover, single- or two-stage thermostats, or any thermostat that provides installer with the level of control which they desire.

In accordance with an embodiment of the present invention, when a call for heating or cooling is started, an electronic controller monitors the temperature of the air leaving the heating or cooling equipment (i.e., the Leaving Air Temperature). The electronic controller monitors the change over unit time in the LAT temperature. Any given piece of HVAC equipment may produce a finite amount of heating and cooling. Therefore, a temperature profile of the LAT will start with a steep curve and then flatten out as the equipment nears capacity. The electronic controller watches for that flattening and then compares the actual LAT to a value assigned during the setup wizard procedure. If the LAT is not warm or cold enough to exceed a minimum heating or a maximum cooling level, then the HVAC equipment is stepped up to a next operational mode with more capacity. That is, the system stages on capacity, not just demand from one or more zones. If the LAT gets too close to a maximum heating ora minimum cooling temperature, then higher stages of capacity are turned off and the system is allowed to operate in a less than full-capacity mode, which is more efficient. If the LAT reaches the assigned setpoint, then the HVAC equipment is turned off to prevent equipment damage.

In accordance with an embodiment of the present invention, during setup each of the defined zones is assigned a relative zone weight. As the logic of capacity and demand are followed and there is a call to increase capacity, the electronic controller will step up to the next highest operational mode. The zone weights being served at that time are totaled. If the total weights are not above a threshold assigned during the setup wizard, then the compressor capacity is increased but the air-handler speed is not increased. This allows a determined amount of air to be delivered to any ductwork configuration without having to resort to allowing some air to escape back through the return (known as bypass air).

The zone weights may be set to any value between 10% and 90%, in accordance with an embodiment of the present invention, which allows an operator to over- or under-serve any particular area, or duct condition. Further, the zone weight is used to set priority between opposing heating or cooling calls and allows an operator to customize the operation of the system to meet the customer's lifestyle to a very high degree.

In accordance with an embodiment of the present invention, there are four choices of priority which are:

1. Zone weight where the relative weights of the zones are totaled by service desired and the service with the greatest weight is served first.

2. Heating where a heating call will be served first and a running cooling call is interrupted.

3. Cooling where a cooling call will be served first and a running heating call is interrupted.

4. Automatic mode where the first in a particular cycle will define the priority system.

In accordance with another embodiment of the present invention, if an opposing call waits for 20 minutes without being served, the priority will switch to that call for up to 20 minutes. After that, the priorities will change back and forth on a 20 minute cycle to prevent unserved or "orphan zones". In accordance with yet another embodiment of the present invention, "Fan Only" ventilation calls are served anytime there are no calls for either heating or cooling.

In accordance with an embodiment of the present invention, the outside air temperature (OAT) sensor readings are used to adjust the minimum heat setting. Such a function takes the place of an additional control required for some installations called and Outside Reset Controller. As the temperature outside gets colder, the equipment will have to provide more heat to maintain inside temperatures. Therefore, the minimum heat setting is adjusted to force the system to operational modes that provide more heating capacity more quickly.

In accordance with an embodiment of the present invention, when the electronic controller is used in conjunction with a heat pump with a fossil fuel backup furnace, the OAT sensor readings are used to determine when to change over from heat generated by an electric heat pump to heat generated by the backup fossil fuel furnace. This is known as "Balance Point" and is a function of the relative efficiency of the heat pump and the furnace as the OAT falls. The Balance Point is assigned during the setup wizard process.

Many electric utilities have incentive programs or regulatory restrictions about when a heat pump may use backup resistance heat. The OAT sensor readings are used to prevent the heat pump from adding resistance heat in an auxiliary mode above a given temperature. That given temperature is assigned during the setup wizard process.

An embodiment of the present invention features a LCD screen as part of the electronic controller to output data to the operator. The output screen shows which calls are being served, which zones are being served, and the total weight of the zones being served. The output screen displays the LAT and OAT temperatures and displays equipment lockouts that are currently in place. Any purges between heating and cooling calls are also displayed.

In accordance with an embodiment of the present invention, each zone has its own display to display what (if anything) that zone's sensor is calling for. The display shows how long that zone has been served or how long until it will be served. The assigned weight for that zone is also displayed.

In accordance with an embodiment of the present invention, the electronic controller provides a variable purge cycle between heating and cooling calls, depending on the equipment that just finished a call. If an electric heat pump was running in a compressor mode, the heat exchange ends very quickly after the compressor(s) are turned off and there is a 30 second wait. At the completion of a fossil fuel furnace cycle, however, there is a large amount of heat stored in the heat exchanger. Therefore, the purge cycle lasts for two minutes.

In accordance with an embodiment of the present invention, if there is a call waiting for service that includes a fan input (G), then the fan call is served without any interruption such that the fan is not switched off and then back on again.

In accordance with another embodiment of the present invention, a variable end of cycle timer is provided by the electronic controller. At the conclusion of the purge cycle, the pump is allowed to run for an assignable period of time with all of the solenoids turned off. This drives all of the zone dampers open, depending on the length of the cycle selected and the number of dampers employed. This is adjustable from 0 to 180 seconds and is assigned during the setup wizard process.

In accordance with an embodiment of the present invention, if the electronic controller detects an emergency heat call, this indicates that the operator has switched the zone 1 thermostat to the "Emergency Heat" position. Likely, this indicates that something has happened to the compressor(s) of the heat pump. The emergency call is latched in until a normal heating call is received indicating that the heat pump has been fixed.

These and other advantages and novel features of the present invention, as well as details of illustrated embodiments thereof, will be more fully understood from the following description and drawings.

BRIEF DESCRIPTION OF SEVERAL VIEWS OF THE DRAWINGS

FIG. 6 is a flowchart of an exemplary embodiment of a method for translating thermostat inputs to HVAC outputs based on the type of HVAC equipment being used, in accordance with various aspects of the present invention.

FIG. 7 is a flowchart of an exemplary embodiment of a method for translating thermostat inputs to electronic controller inputs based on zone, in accordance with various aspects of the present invention.

FIGS. 8*a*-8*b* show exemplary embodiments of setting options that may be displayed to an operator of the electronic controller via a display device, in accordance with various aspects of the present invention.

FIG. 19 illustrates a flowchart of an exemplary embodiment of a method for performing a cooling stage-up procedure, in accordance with various aspects of the present invention.

FIGS. 20*a*-20*b* illustrate a flowchart of an exemplary embodiment of a method for performing a cooling procedure, in accordance with various aspects of the present invention.

FIGS. 23*a*-23*c* illustrate a flowchart of an exemplary embodiment of a method for performing a heating procedure, in accordance with various aspects of the present invention.

DETAILED DESCRIPTION OF THE INVENTION

Figure 1:
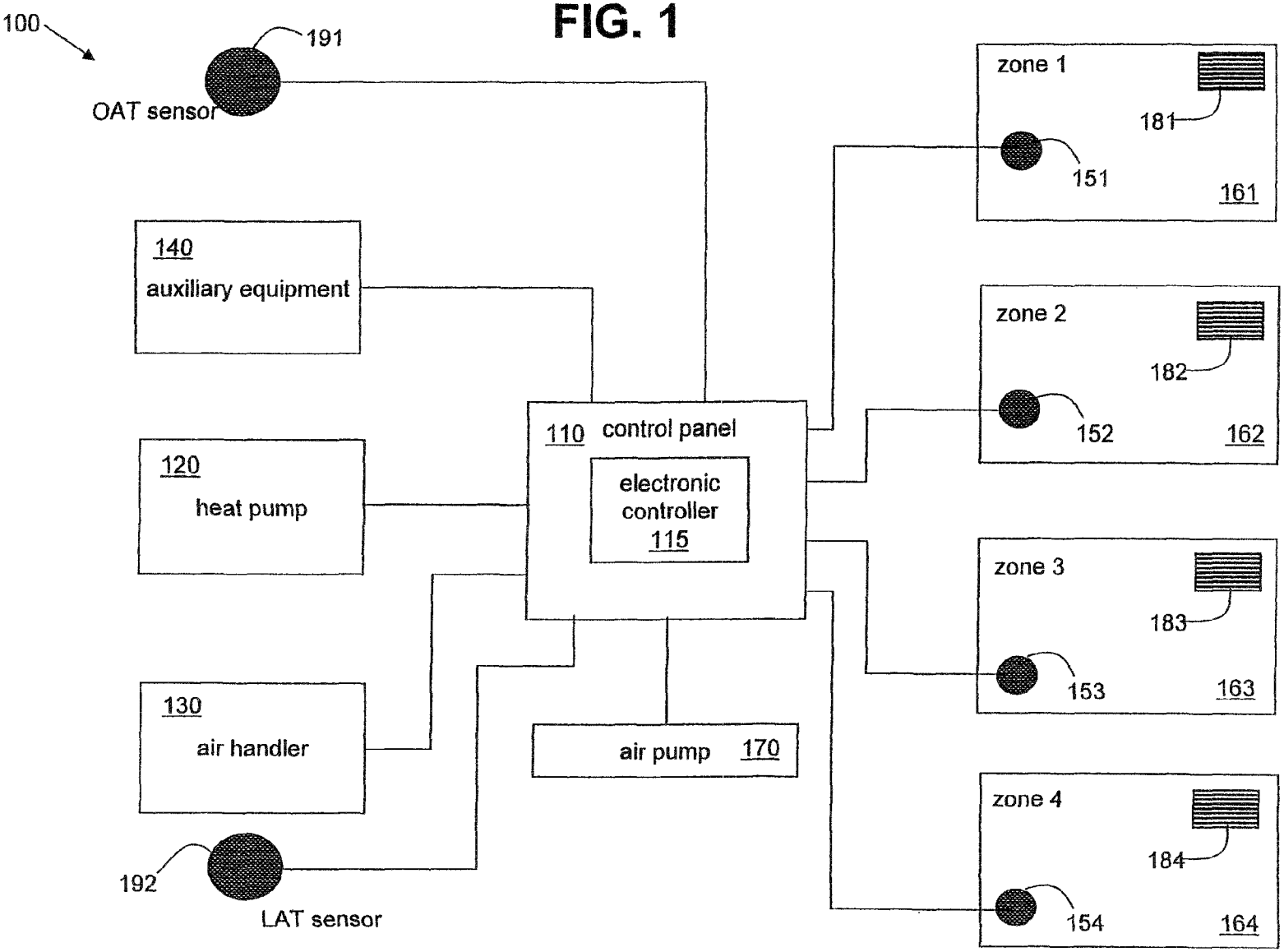
FIG. 1 illustrates a schematic block diagram of an exemplary embodiment of a system to control environmental parameters of pre-defined zones within a first environment, in accordance with various aspects of the present invention.

As used herein, the term "non-proprietary" means useable with any standard commercial forced air system (e.g., any standard commercial heat pump system). FIG. 1 illustrates a schematic block diagram of an exemplary embodiment of a system 100 to control environmental parameters of pre-defined zones within a first environment, in accordance with various aspects of the present invention. The system 100 includes a control panel 110, at the heart of the system 100, which includes an electronic controller 115. The system 100 further includes a heat pump 120 and an air handler 130 both operationally connected to the control panel 110 such that the operation of the heat pump 120 and the air handler 130 may be controlled by the electronic controller 115 of the control panel 110. The system 100 also includes auxiliary equipment 140 operationally connected to the control panel 110 such that the operation of the auxiliary equipment 140 may be controlled by the electronic controller 115 of the control panel 110.

The system 100 further comprises sensor devices 151-154 each operationally connected to the electronic controller 115 with each one of the sensor devices occupying a zone (161-164) of an environment to be environmentally controlled. The sensor devices are used to call for service. The system 100 also includes at least one air pump device 170 operationally connected to the control panel 110 such that the distribution of air may be controlled by the electronic controller 115 of the control panel 110. The system 100 further includes at least one air damper 181-184 associated with each of the zones 161-164 and being operationally connected to the air pump device 170. In accordance with an alternative embodiment of the present invention, the dampers 181-184 may be electromechanical dampers or any other type of damper. The system also includes an outside air temperature (OAT) sensor 191 and a leaving air temperature (LAT) sensor 192 each operationally connected to the electronic controller 115 of the control panel 110. The OAT sensor measures the temperature of the outside air in a second environment which is external to the first indoor environment. Each zone may comprise a separate room or connected areas in a house or other building, for example. Zones may also be defined by a time of day. For example, a bedroom zone may only be dynamically controlled at night when the bedroom is in use, and left closed off during the day when the bedroom is not in use. Similarly, an office building or restaurant not used at night may be closed off at certain hours of the night and dynamically controlled during the day.

In accordance with an embodiment of the present invention, the control panel 110 includes not only the electronic controller 115 but other components, as well, such as solenoids, relays, and a power supply for providing power and/or control air to the various system elements (i.e., the heat pump 120, the air handler 130, the air dampers 181-184, etc.) through activation by the electronic controller 115. For example, to turn on the heat pump 120, the electronic controller 115 activates relays in the control panel 110 to switch electrical power to the heat pump 120. As another example, to provide air from the air pump device 170 to one of the air dampers 181-186, the electronic controller 115 activates (via an activation signal) a solenoid on the control panel 110 to switch air to an air damper (e.g., 181). In general, the electronic controller 115 is a non-proprietary controller and independently controls activation of the heat pump 120, air handler 130, auxiliary equipment 140, and the air dampers 181-184 when properly configured to a particular forced air system having such components.

The electronic controller 115 also receives input signals from the various sensor devices 151-154, 191, and 192. The sensor devices 151-154 may include, for example, thermostats and/or humidistats for monitoring temperature and/or humidity of the corresponding zones 161-164. The electronic controller 115 uses these input signals to determine when and how to activate the various equipment (120, 130, 140, 170).

The auxiliary equipment 140 may include an auxiliary heating source such as a fossil fuel system. Such an auxiliary heating source may include a gas, propane, or oil furnace, or a resistive heat strip, for example. Other auxiliary equipment such as, for example, auxiliary cooling equipment (e.g., an air conditioner) and a humidifier are possible as well, in accordance with various embodiments of the present invention.

In general, the heat pump 120, air handler 130, and auxiliary equipment 140 may include one or more stages of operation. Since the controller 115 is non-proprietary, the controller 115 may be configured to work with any standard forced air system having any standard number of stages. For example, the heat pump 120 may include two compressor stages of operation where either only the first compressor stage is activated, or both the first and second compressor stages are activated (e.g., when more cooling is needed). The air handler 130 may include two stages or speeds of operation such as, for example, a low fan speed stage and a high fan speed stage. The auxiliary equipment 140 may include, for example, two heat strip stages of operation where either only the first heat strip stage is activated, or both the first and second heat strip stages are activated (e.g., when more heat is needed). In accordance with an embodiment of the present invention, the activation of the various stages of the equipment may be controlled independently by the electronic controller 115 based on the determined need for heating, cooling, humidification, and/or dehumidification.

Figure 2:
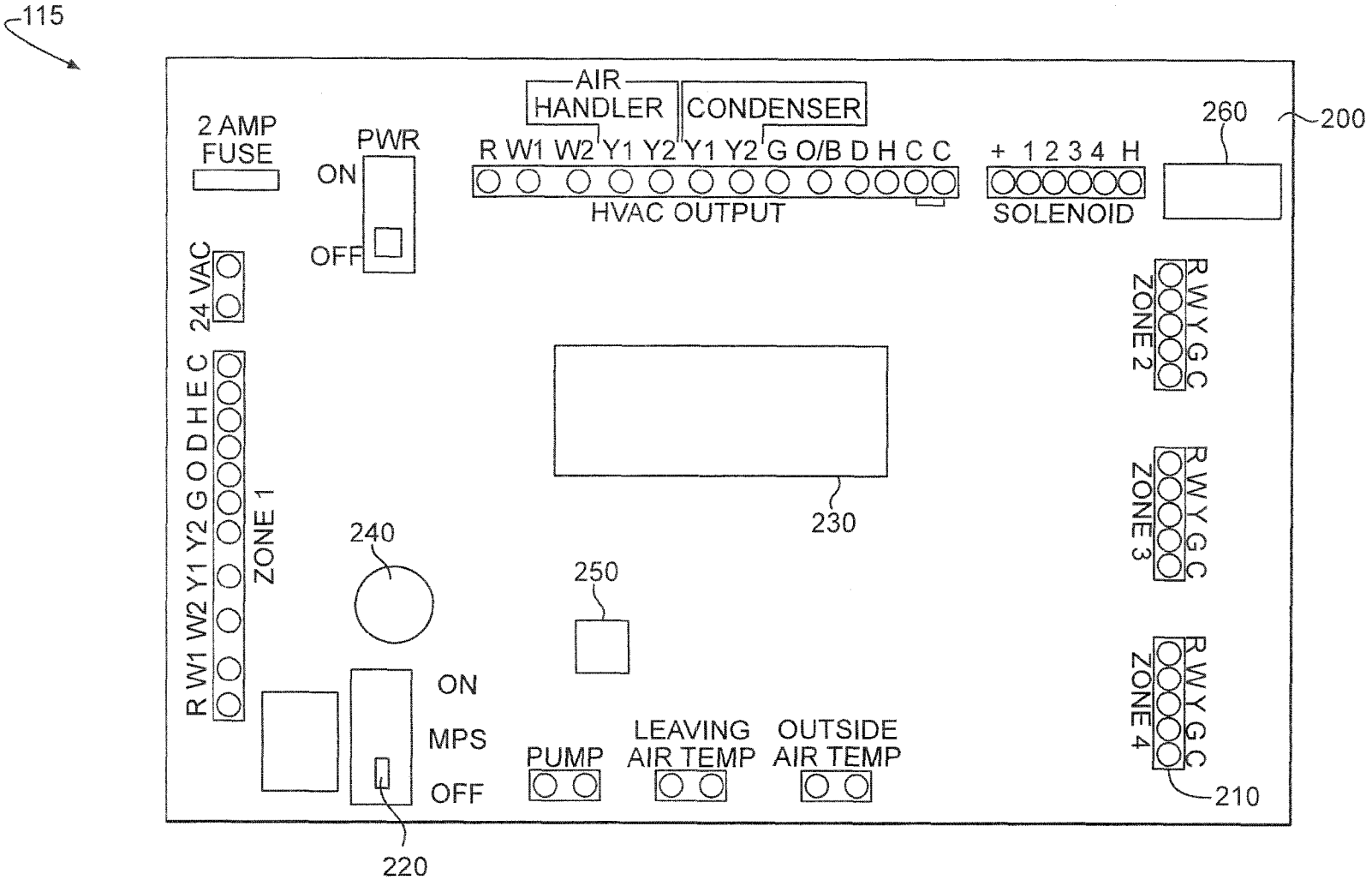
FIG. 2 is an illustration of an exemplary embodiment of an electronic controller used in the system of FIG. 1, in accordance with various aspects of the present invention.

FIG. 2 is an illustration of an exemplary embodiment of an electronic controller 115 used in the system 100 of FIG. 1, in accordance with various aspects of the present invention. The electronic controller 115 comprises a circuit board 200 with various components and devices mounted to the circuit board 200 including terminals (e.g., 210), switches (e.g., 220), a microprocessor, an LCD display device 230, resistors, capacitors (e.g., 240), integrated circuit chips (e.g., 250), as well as other components.

In accordance with an embodiment of the present invention, the display device 230 may be used by an operator to aid the operator in manually selecting setting options (e.g., a first, a second, a third set of options, etc.) which are pre-programmed into the electronic controller 115. Such manual selecting includes the steps of powering up the electronic controller 115, displaying a first set of options on the display device 230, selecting at least one of the options from the first set of options using at least one switching device on the electronic controller 115, displaying a second set of options on the display device 230, and selecting at least one of the options from the second set of options using at least one switching device on the electronic controller 115. The process of displaying a next set of options and selecting from the next set of options may continue until all available selections are made. A list of selections and associated setting options are presented later herein. Also, the LCD display device 230 functions as an input/output indicator by displaying each thermostat call and the service currently being provided, in accordance with an embodiment of the present invention.

The electronic controller 115 further includes a USB (universal serial bus) port 260. The USB port 260 allows a personal computer (PC), for example, to interface to the electronic controller 115. In accordance with an embodiment of the present invention, the electronic controller 115 stores a history of operational data which may be read out of the electronic controller 115 by the PC via the USB port 260. The history of operational data may include, for example, a listing of zone service calls that occurred over the last 24 hours or more, and a listing of stage activations initiated by the electronic controller 115 over the last 24 hours or more. Such historical information may be used by a technician to troubleshoot the system 100. Also, in accordance with an embodiment of the present invention, a set of default options may be reloaded from the PC into the electronic controller 115 via the USB port 260. Reloading the set of default options overrides any manual option selections that were previously made via the display device 230.

Also, in accordance with an embodiment of the present invention, the USB port 260 may be used to allow the electronic controller 115 to interface with home automation equipment (e.g., a home automation device). The software of the electronic controller 115 is designed with "hooks" for integration with home automation packages. Data that may be output via the USB port to a home automation package include the last five events, the current damper states, the current service being provided, the current LAT, the current OAT, and any current thermostat or sensor requests. The home automation equipment may include a separate device with software that takes the data provided by the controller 115 and reports the data to a remote user via a dialer capability, email, or a web-based interface, for example. The user may have the capability to respond to the report in a similar manner in order to, for example, change the temperature in the home or turn off part of the HVAC system. The interface between the controller 115 and the home automation equipment may be wired or wireless, in accordance with various embodiments of the present invention.

Figure 3:
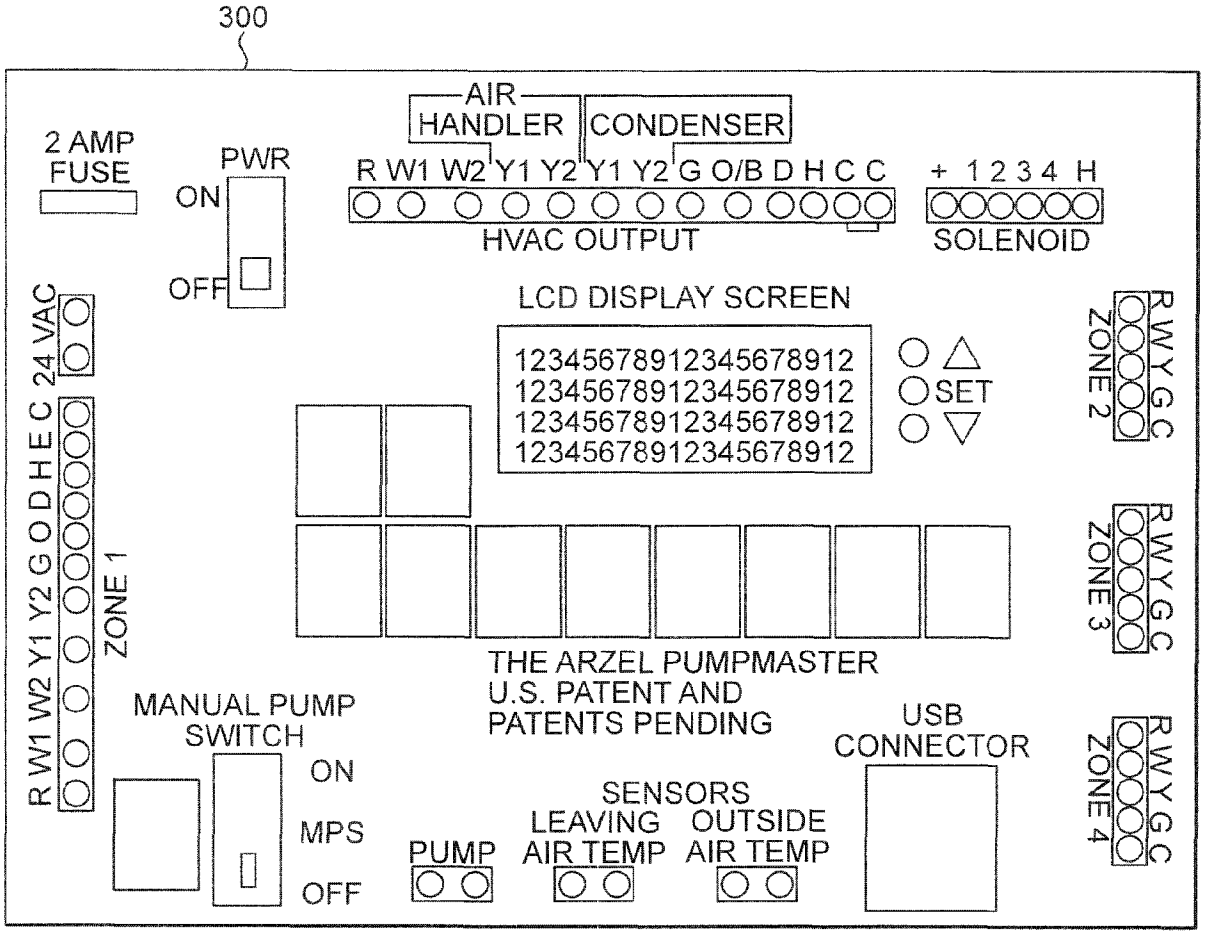
FIG. 3 is a schematic illustration of an embodiment of the layout of terminals, switches, and certain other components of an electronic controller used in the system of FIG. 1, in accordance with various aspects of the present invention.

FIG. 3 is a schematic illustration of an embodiment of the physical layout 300 of terminals, switches, and certain other components of the electronic controller 115 used in the system 100 of FIG. 1, in accordance with various aspects of the present invention.

Figure 4:
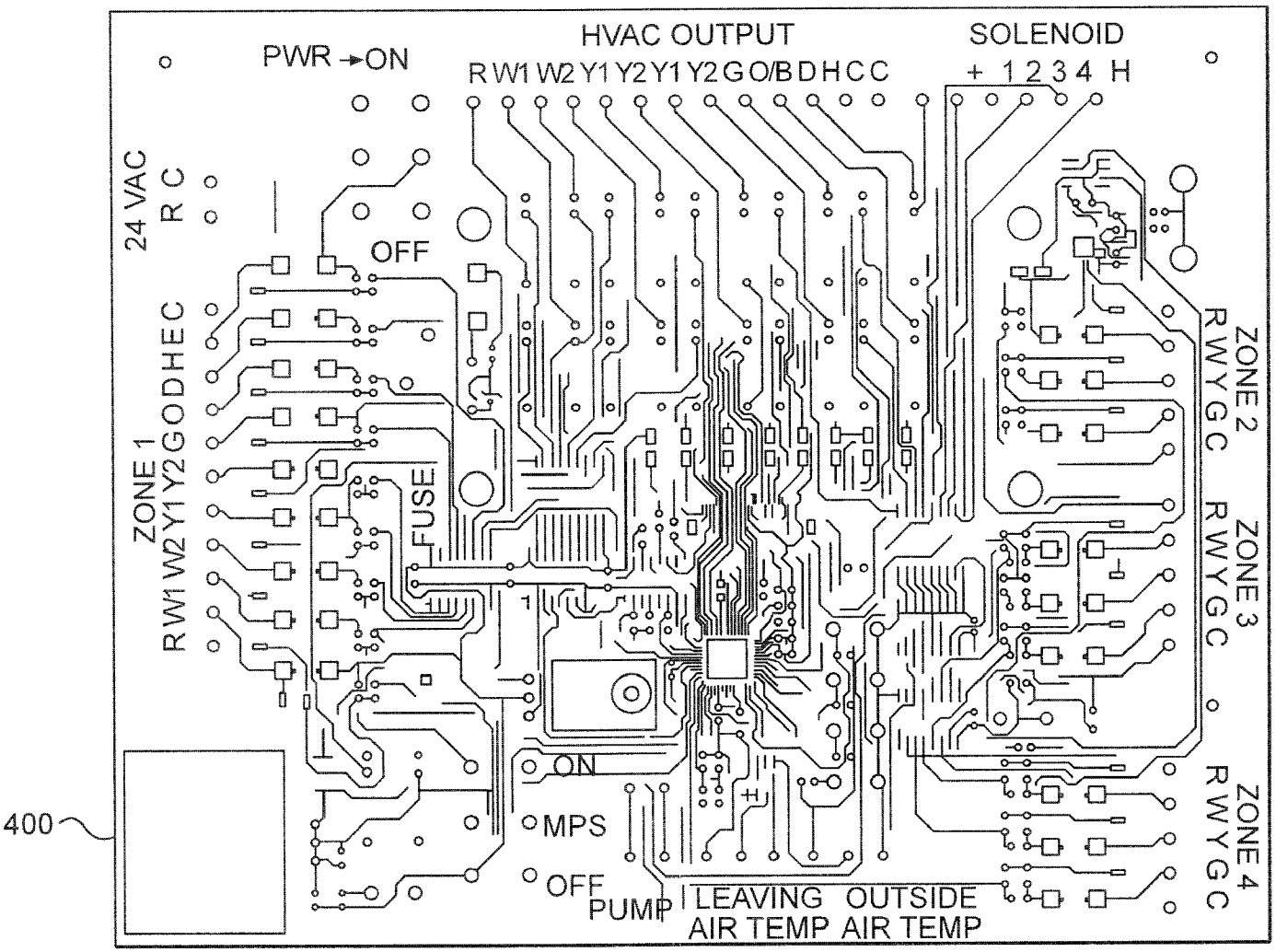
FIG. 4 is a schematic illustration of an embodiment of a circuit board layout of the electronic controller of FIG. 2, in accordance with various aspects of the present invention.

FIG. 4 is a schematic illustration of an embodiment of a circuit board layout 400 of the electronic controller 115 of FIG. 2, in accordance with various aspects of the present invention.

Figure 5:
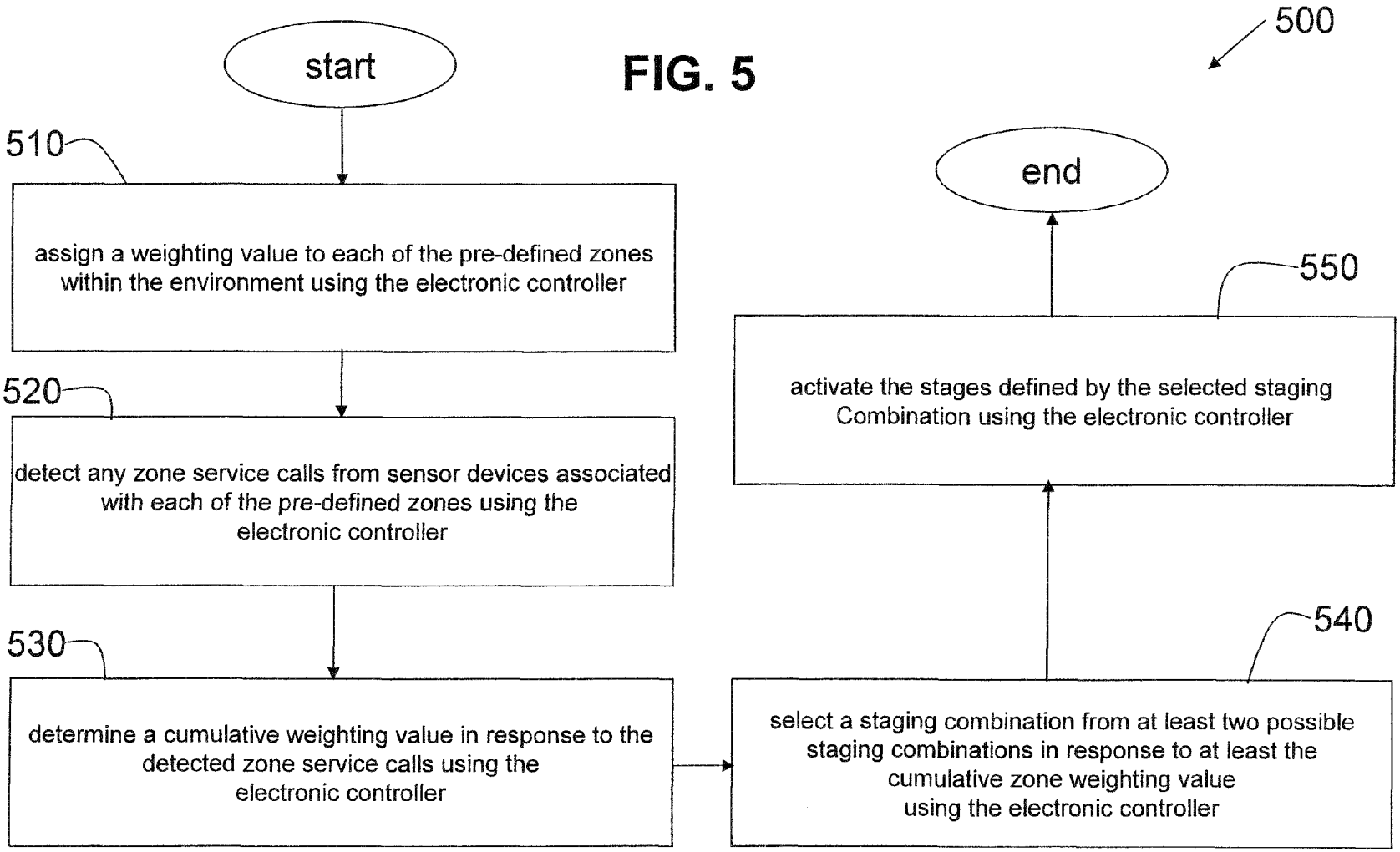
FIG. 5 illustrates a flowchart of an embodiment of a method to control environmental parameters of pre-defined zones within a first environment using the system of FIG. 1 which includes the electronic controller of FIG. 2, in accordance with various aspects of the present invention.

FIG. 5 illustrates a flowchart of an embodiment of a method 500 to control environmental parameters of pre-defined zones within a first environment using the system 100 of FIG. 1 which includes the electronic controller 115 of FIG. 2, in accordance with various aspects of the present invention. In step 510, a weighting value is assigned to each of the pre-defined zones within a first environment using an electronic controller. In step 520, any zone service calls from sensor devices associated with each of the pre-defined zones are detected using the electronic controller. In step 530, a cumulative weighting value is determined in response to the detected zone service calls using the electronic controller. In step 540, an equipment staging combination is selected from at least two possible equipment staging combinations in response to at least the cumulative zone weighting value using the electronic controller. In step 550, the stages defined by the selected equipment staging combination are activated using the electronic controller.

As an example, referring to FIG. 1, zone 1 161 may be assigned a weighting value of 35%, zone 2 162 may be assigned a weighting value of 10%, zone 3 163 may be assigned a weighting value of 20%, and zone 4 164 may be assigned a weighting value of 45%. These weighting values may be assigned based on the square footage area (i.e., floor space) of the zones or the separate spatial volumes of the zones, for example. In general, a larger zone may receive a higher weighting value. Also, weighting values may be based on the criticality of protecting equipment or produce in a zone (e.g., protecting expensive computer equipment or perishable food).

The weighting values for the various zones are programmed into the electronic controller 115 by an operator using the LCD display 230 and associated switches as a user interface. Next, zone service calls are detected by the electronic controller 115 from thermostat 151 in zone 1 161 and thermostat 154 in zone 4 164. Both zones are calling for more heat. Since the weighting value associated with zone 1 161 is 35% and the weighting value associated with zone 4 164 is 45%, the cumulative weighting value is the sum of the two which is 80%, which is a fairly high cumulative weighting value, and is higher than a pre-defined zone weighting threshold of, for example, 60%.

As a result, the electronic controller 115 selects an equipment staging combination which includes two or more compressor stages of the heat pump 120 and a second higher air blower speed of the air handler 130. The selected stages are activated by the electronic controller 115 via the control panel 110, and the electronic controller 115 directs air from the air pump device 170 to the air dampers 181 and 184 in zone 1 161 and zone 4 164 in order to open these air dampers. As a result, the heat pump 120 provides heat to the air handler 130 which blows heated air to zone 1 161 and zone 4 164. The dampers 182 and 183 in zone 2 162 and zone 3 163 remain closed. Once the servicing of the zones is completed, the air dampers may be closed by the electronic controller 115.

A zone service call may include any of a heating call, a cooling call, a humidification call, a de-humidification call, and a fan-only call, in accordance with an embodiment of the present invention.

Continuing with the example, once zone 1 161 and zone 4 164 are properly heated, the electronic controller 115 closes the dampers 181 and 184 and de-activates the two stages of the heat pump 120 and the air handler 130. Next, the electronic controller 115 receives and detects a new zone service call from the thermostat 152 of zone 2 162. The weighting value associated with zone 2 162 is 10%. Since zone 2 162 is the only zone calling, the cumulative weighting value is also 10% which is below the threshold of 60%. As a result, the electronic controller 115 selects a new equipment staging combination which includes a first compressor stage of the heat pump 120 and a first lower air blower speed of the air handler 130. The selected stages are activated by the electronic controller 115 via the control panel 110, and the electronic controller 115 directs air from the air pump device 170 to the air dampers 182 in zone 2 162 in order to open this air damper. As a result, the heat pump 120 provides heat to the air handler 130 which blows heated air to zone 2 162. The dampers 181, 183 and 184 in zone 1 161, zone 3 163, and zone 4 164 remain closed.

As may be seen from the previous example, the weighting of the zones, the determination of a cumulative weighting value, and the independent control and activation of the heat pump stages and the air handler stages allow the system 100 to select the best combination of equipment stages to be activated in order to properly heat the calling zones in a more efficient manner. Similarly, other types of zone service calls such as cooling, humidification, dehumidification, and fan-only may be effected in the same way by allowing the system 100 to select, via the electronic controller 115, the best combination of stages of the heat pump 120, the auxiliary equipment 140, and the air handler 130. For example, for certain applications, it has been found that the best staging combination involves using the zone weighting values only to stage the air handler 130, independent of the staging of the other equipment. The controller 115 allows the air handler 130 and the other equipment to be controlled and staged independently. For example, the heat pump may be staged based on LAT and OAT, but not zone weightings, and the air handler is staged based on zone weightings. That is, the air handler staging, in this embodiment, is based strictly on zone weighting and not temperature. In this way, airflow may be better matched to duct capacity. The zone weightings for the air handler are based on the amount of ductwork being served at any one time for the calling zones.

In accordance with an embodiment of the present invention, one or more of the sensors 151-154 may include a humidistat for measuring a humidity level in a zone, or may be a combination thermostat/humidistat for measuring temperature and humidity level in a zone. When a zone calls for lowering the humidity level, two or more stages of the heat pump may be employed to provide maximum cooling capacity but only the first stage (i.e., lower speed) of the air handler may be activated such that the lower speed of the air passing over the cooling coils in the heat pump will allow more moisture to condense out of the air, for example.

Various staging combinations are provided by the electronic controller 115 in an attempt to better control the environmental parameters (e.g., temperature, humidity, air flow)

within the various zones. In accordance with an embodiment of the present invention, the allowable staging combinations may be as follows:

1) a first stage of a heat pump and a first stage (low speed) of an air handler;

2) a first stage and a second stage of a heat pump and a first stage (low speed) of an air handler;

3) a first stage and a second stage of a heat pump and a second stage (high speed) of an air handler;

4) a first stage and a second stage of a heat pump, a second stage (high speed) of an air handler, and a first stage of an auxiliary heat source;

5) a first stage and a second stage of a heat pump, a second stage (high speed) of an air handler, and a first stage and a second stage of an auxiliary heat source.

Each of the staging combinations includes a unique, predefined combination of heat pump and/or auxiliary equipment stages that may be activated by the electronic controller along with different air handler stages that may be activated by the electronic controller for servicing the calling zones. Other staging combinations are possible as well, in accordance with various embodiments of the present invention. For example, a staging combination may include turning on a fan of the air handler 130 without activating any stages of the heat pump 120 or auxiliary equipment 140. This may be desirable simply to move air around a zone or zones, or to bring outside air in from outside of the house or building (i.e., from an external environment), for example. Again, in accordance with another embodiment of the present invention, only the air handler may be staged on zone weighting.

The outside-air-temperature (OAT) sensor 191 may be used to report a temperature of the outside (i.e., external) environment to the electronic controller 115. As a result, the electronic controller may 115 may use the outside-air-temperature as another input in the process to decide which stages to activate when a zone or zones is calling for service. For example, if it is the middle of winter and a user of the system 100 is entertaining a large number of people within a building such as, for example, a home, a restaurant, or a hotel, the temperature within the building may start to increase to an uncomfortable level. The outside-air-temperature as measured by the OAT sensor 191 and reported to the electronic controller 115 may be, for example, 40 degrees F. When the temperature inside a zone of the building reaches an uncomfortably warn level, the electronic controller 115 may open a damper to the outside and activate the air handler 130 to allow the cool outside air to be brought into the building instead of turning on an air conditioner or activating the heat pump 120 for cooling. Furthermore, the measured OAT may be used to determine whether or not any auxiliary equipment is allowed to be activated.

In accordance with an embodiment of the present invention, if the OAT is below a balance point threshold value, then any backup auxiliary heating will be used. If the OAT is below a low ambient threshold value, then cooling calls are served with the fan only. If the OAT is above a high ambient threshold value, then heating calls are served with the fan only. If the OAT is above an auxiliary heat lockout threshold value, then auxiliary heat is not allowed.

The leaving-air-temperature (LAT) sensor 192 may be used to report a temperature of the air leaving the air handler 130 to the electronic controller 115. As a result, the electronic controller 115 may use the leaving-air-temperature as another input in the process of deciding which stages to activate when a zone or zones is calling for service. That is, the system stages on thermal capacity, not just demand from one or more zones. The system does not have to wait for a thermostat to fall below or rise above a set temperature within a zone and call for more heating or cooling before reacting by changing the staging. For example, a first stage of the heat pump 120 may be used to cool zones within a house when the outside-air-temperature is around 80 degrees F. In such a scenario, the leaving-air-temperature from the air handler 130 may typically be around 70 degrees F. and does a fine job of cooling the calling zones to 74 degrees F. within a reasonable period of time. However, on a very hot day when the outside-air-temperature is above 95 degrees F., with only the first stage of the heat pump 120 activated, the leaving-air-temperature may only cool down to 75 degrees F., which is not suitable if the desired zone temperature is 74 degrees F. Therefore, under such conditions, the electronic controller 115 would detect that the leaving-air-temperature was too high and would activate both the first and second stages of the heat pump 120 in an attempt to reduce the leaving-air-temperature. Many other scenarios are possible as well which may be handled by embodiments of the present invention.

Whenever one or more of the sensed parameters (e.g., temperature, humidity), from a sensor sensing a present status of at least on of the environmental parameters, changes within a zone, or OAT or LAT changes, the electronic controller 115 may select a new staging combination which is more appropriate for the new conditions. The electronic controller 115 provides the flexibility needed to better control environmental parameters within a home, building, or other environment, for example. That is, multiple controls (functions) are built into the controller 115, eliminating the need for separate control devices. In accordance with an embodiment of the present invention, the controller 115 includes built-in controls for resistance heat lock-out capability, outdoor reset capability, outdoor temperature balance point capability, discharge temperature (LAT) controls (two independent high limits and one low limit), and selectable O/B outputs. As a result, the controller 115 could be used simply as, for example, a heat pump controller and not a zone controller. The two independent LAT high limits include a first limit for setting the maximum allowable temperature for heat-pump only operation, and a second limit for setting the maximum temperature for heat-pump plus some form of backup or auxiliary heat. The low LAT limit is for setting the minimum allowable temperature across the coil for cooling. Staging decisions are made based on these limits being exceeded or not, for example.

In general, the various methods described herein with reference to the various flow charts are performed by the electronic controller 115. The electronic controller 115 accepts various input signals, performs various logic functions and calculations based on, at least in part, those input signals, and outputs various output signals to control the various equipment of the system 100.

FIG. 6 is a flowchart of an exemplary embodiment of a method 600 for translating thermostat inputs to HVAC outputs based on the type of HVAC equipment being used, in accordance with various aspects of the present invention. Such a translation demonstrates the non-proprietary nature of the controller 115. In the method 600, a reversing valve output is set based on the type of HVAC equipment being used. In accordance with an embodiment of the present invention, the electronic controller 115 performs the translation.

FIG. 7 is a flowchart of an exemplary embodiment of a method 700 for translating thermostat inputs to electronic controller inputs based on zone, in accordance with various aspects of the present invention. Such a translation demonstrates the non-proprietary nature of the controller 115. The method 700 determines which inputs the electronic controller 115 looks for from the zone 1 thermostat.

FIGS. 8*a*-8*b* show exemplary embodiments of setting options that may be displayed to an operator of the electronic controller 115 via the display device 230, in accordance with various aspects of the present invention. For example, the weighting values associated with each zone (e.g., zones 1-4) may be selected in 10% increments for each zone from anywhere between 10% to 90% inclusive. Other setting options than those shown in FIGS. 8*a*-8*b* are possible as well, in accordance with alternative embodiments of the present invention.

Figure 9:
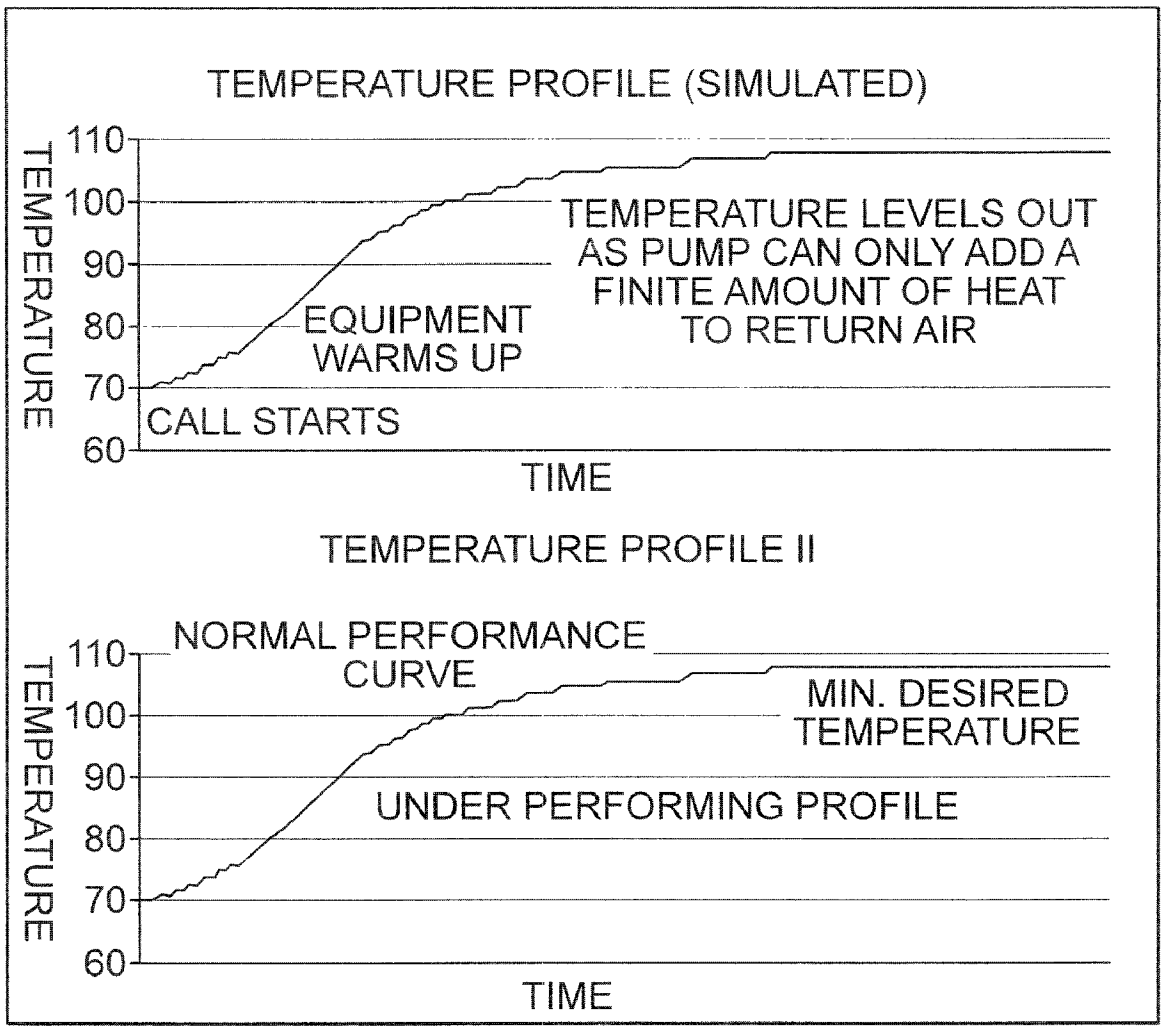
FIG. 9 illustrates graphs of heating temperature profiles, in accordance with an embodiment of the present invention.

FIG. 9 illustrates graphs of heating temperature profiles 900, in accordance with an embodiment of the present invention. Once a sensor (e.g., a thermostat) calls for heat, the equipment (e.g., heat pump) is activated and begins to warm up. The leaving air temperature (LAT) increases and then levels off at some point. The change in LAT over a given unit of time is defined as ΔT. In accordance with an embodiment of the present invention, the LAT sensor 192 is used to determine ΔT. ΔT indicates the change in temperature from one unit of time to the next and indicates whether or not the heat pump is keeping up with demand. In accordance with an embodiment of the present invention, ΔT is the basis of all equipment staging decisions. That is, the system stages, at least in part, based on thermal capacity.

ΔT starts out small as the coil and condenser of the heat pump start to work. Then ΔT increases as the equipment gets up to speed. Finally, ΔT decreases and eventually goes to zero as the temperature levels out. In accordance with an embodiment of the present invention, ΔT is used as a flag for making staging decisions. That is, the system stages, at least in part, based on thermal capacity. It is typically known, apriori, how the equipment has been designed to operate with respect to equipment profiles. Therefore, a decision can be made as to when the current operating mode of the equipment is sufficient or when heating capacity should be increased. A minimum desired temperature is also known. If ΔT goes to zero but is still below the desired temperature, then the equipment is not generating enough heat to get the job done. As a result, the equipment will be upstaged to provide the additional heat. In accordance with an embodiment of the present invention, the electronic controller 115 checks to ensure that ΔT starts out with a strong magnitude to prove that the heat pump is operating.

Figure 10:
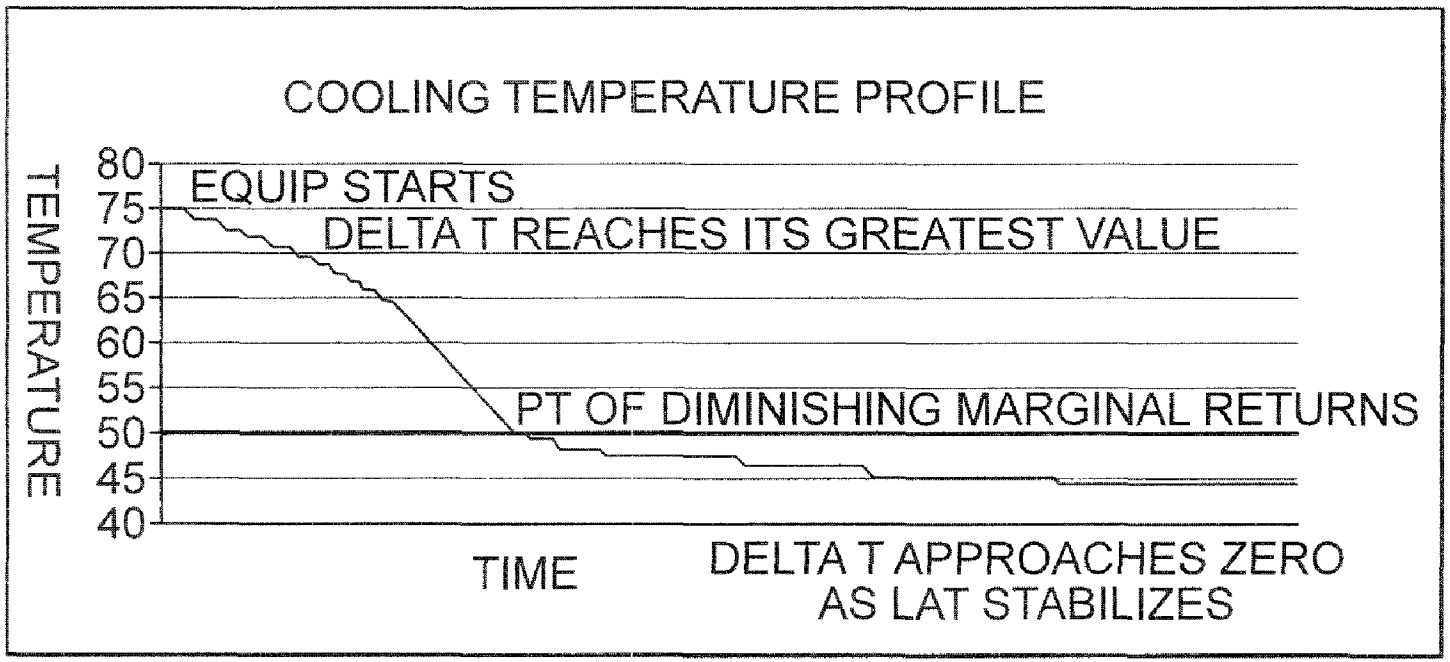
FIG. 10 illustrates a graph of a cooling temperature profile, in accordance with an embodiment of the present invention.

FIG. 10 illustrates a graph of a cooling temperature profile 1000, in accordance with an embodiment of the present invention. Cooling works in a similar manner to heating, except in the opposite direction. As the coolant reaches its most efficient speed for heat transfer, the temperature starts to fall more quickly. Therefore |ΔT| reaches its highest point. Once the temperature profile proceeds below the point of diminishing marginal returns, the |ΔT| starts to decrease. As the equipment continues to run and remove all the heat it can, the leaving air temperature (LAT) reading stabilizes and ΔT becomes very close to zero. Such temperature characteristics may be monitored and used to stage at the appropriate time (i.e., staging based on thermal capacity).

Figure 11A:
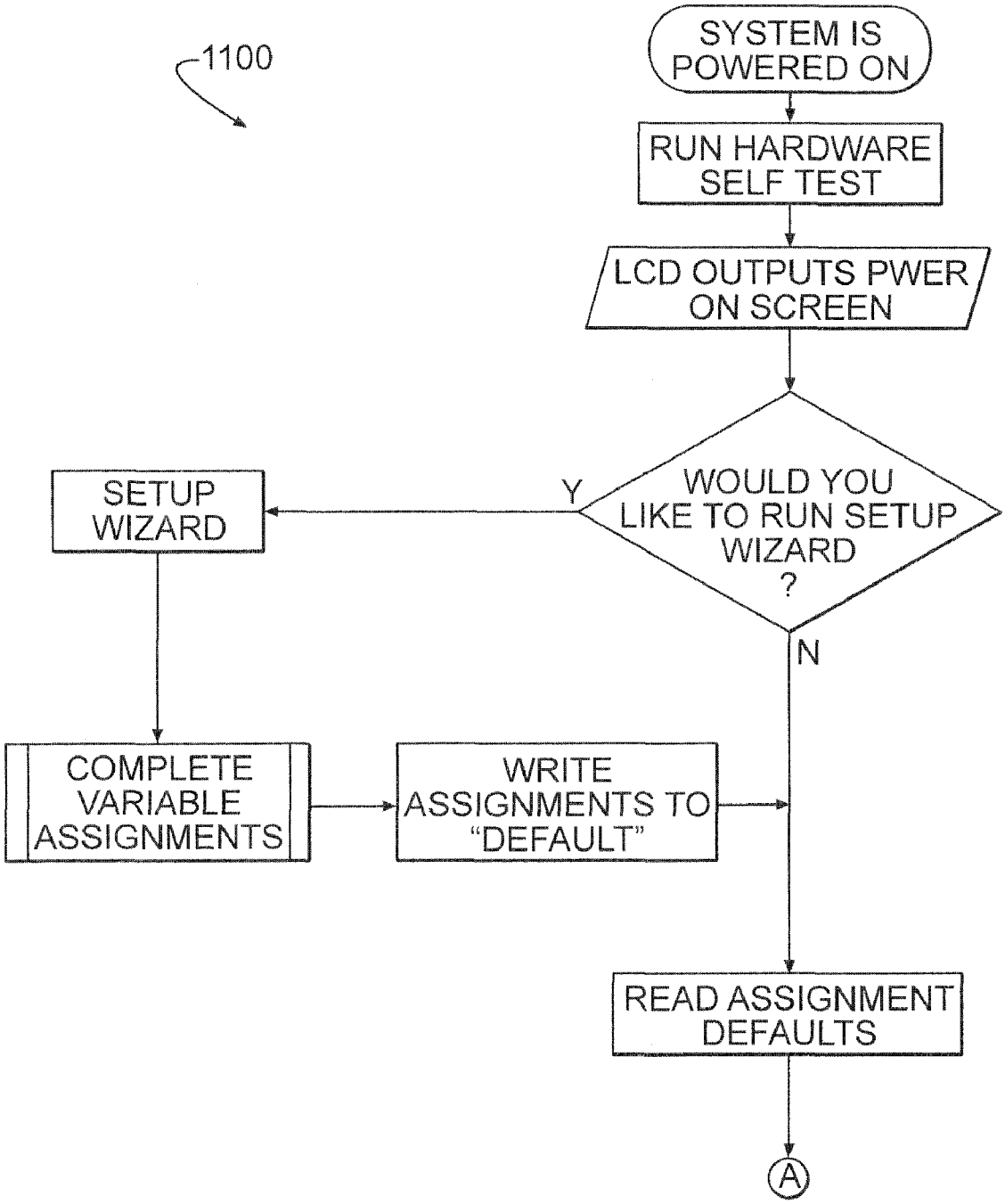
FIGS. 11*a*-11*b* illustrate a flowchart of an exemplary embodiment of a method of general system operation of the system of FIG. 1, in accordance with various aspects of the present invention.
Figure 11B:
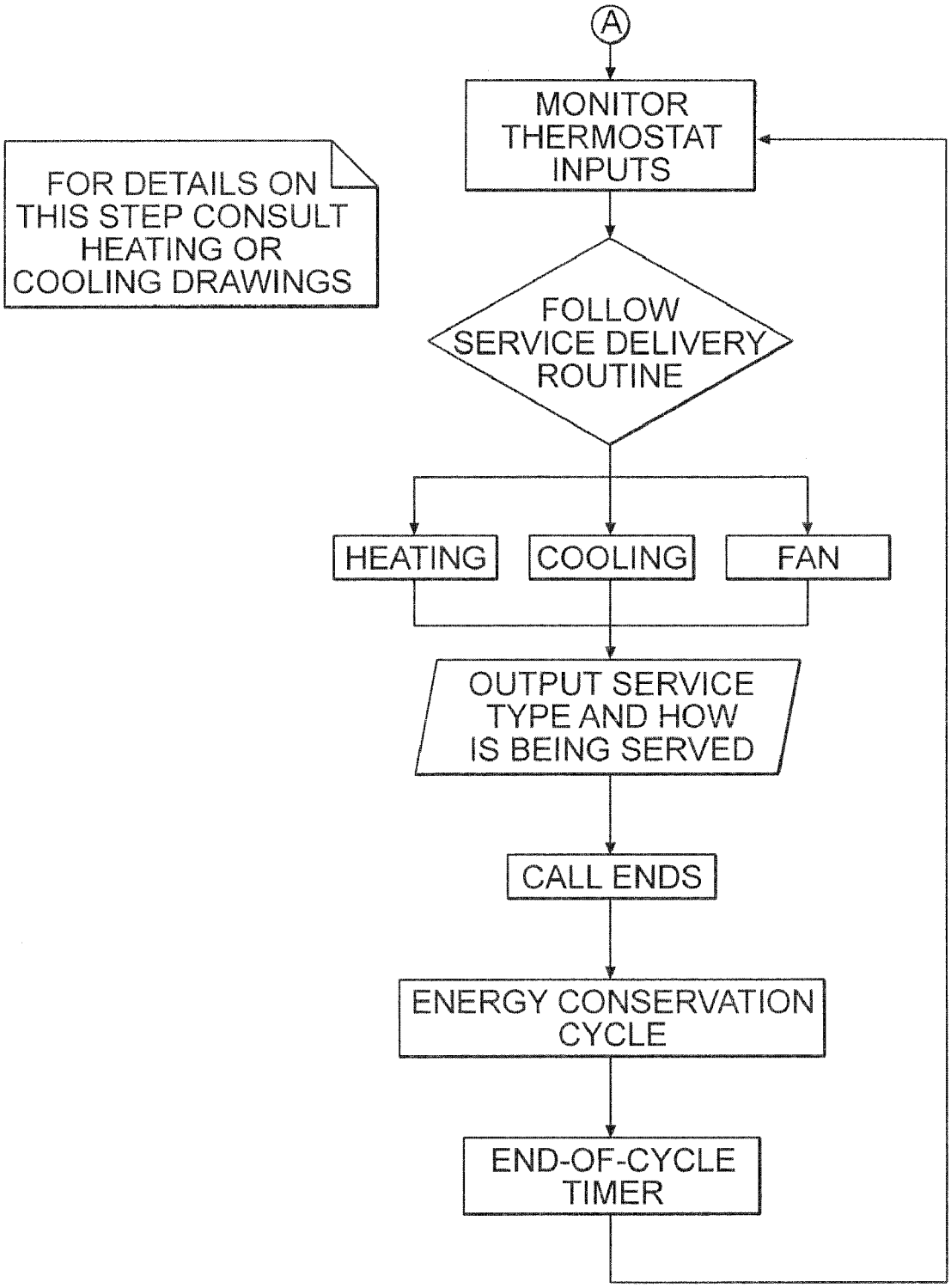

FIGS. 11*a*-11*b* illustrate a flowchart of an exemplary embodiment of a method 1100 of general system operation of the system 100, in accordance with various aspects of the present invention. The method 1100 includes running a "Setup Wizard" which includes selecting the various setting options displayed to an operator on the display device 230. The method 1100 also includes monitoring sensor (e.g., a thermostat and/or a humidistat) inputs and selecting an appropriate service routine to run (e.g., heating, cooling, fan-only).

In general, the electronic controller 115 monitors the progress of the heating or cooling process and adjusts the staging to produce enough heat transfer to get the job done in an efficient manner while minimizing airflow when only small zones are calling. ΔT is the difference between two temperature readings over a given time increment and is the basis for monitoring system performance. In accordance with an embodiment of the present invention, when the electronic controller 115 starts to service a call, the electronic controller 115 will wait approximately one minute and then start to take temperature readings (LAT readings). The electronic controller 115 averages enough readings to effectively filter out any anomalous readings.

The process is monitored in three ways, in accordance with an embodiment of the present invention. First, the rate at which the temperature is rising or falling during the initial heating or cooling process is monitored. Second, the final temperature is recorded when ΔT decreases to nearly zero. The final recorded temperature value should be above (for heating) or below (for cooling) a minimum setting which should feel comfortable to end users. Third, if ΔT changes from a positive value to a negative value, then this means that the heat pump, for example, is not keeping up with demand and the thermostat will soon start to move away from setpoint rather than toward it. ΔT is monitored to see if it changes sign and this information is also used to decide whether or not to stage up.

The decision to stage up is checked against the cumulative zone weighting value. If the cumulative zone weighting value does not exceed a zone weight threshold, the staging up is delayed until the LAT has drifted 5 degrees F. below (for heating) or above (for cooling) the minimum heat or maximum cooling settings. The decision to stage up is also checked against the OAT, in accordance with an embodiment of the present invention. For heating, if the OAT is above 45 degrees F., for example, then the system is not allowed to stage up until the LAT has drifted 5 degrees F. below the minimum heat settings. For cooling, if the OAT is below 75 degrees F., then the system is not allowed to stage up until the LAT has drifted 5 degrees F. above the maximum cooling settings.

Figure 12A:
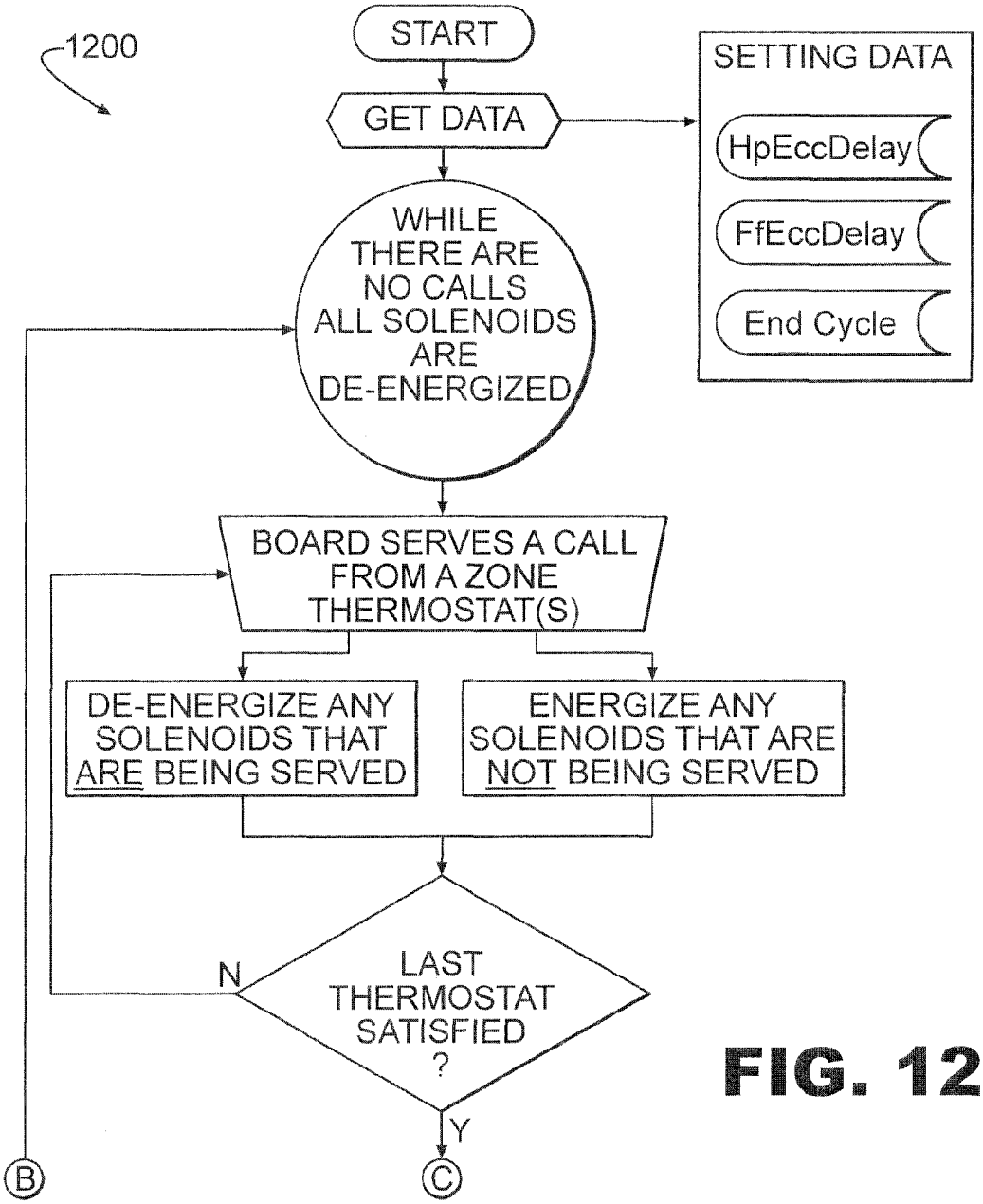
FIGS. 12*a*-12*b* illustrate a flowchart of an exemplary embodiment of a method of solenoid operation on the control panel of the system of FIG. 1, in accordance with various aspects of the present invention.
Figure 12B:
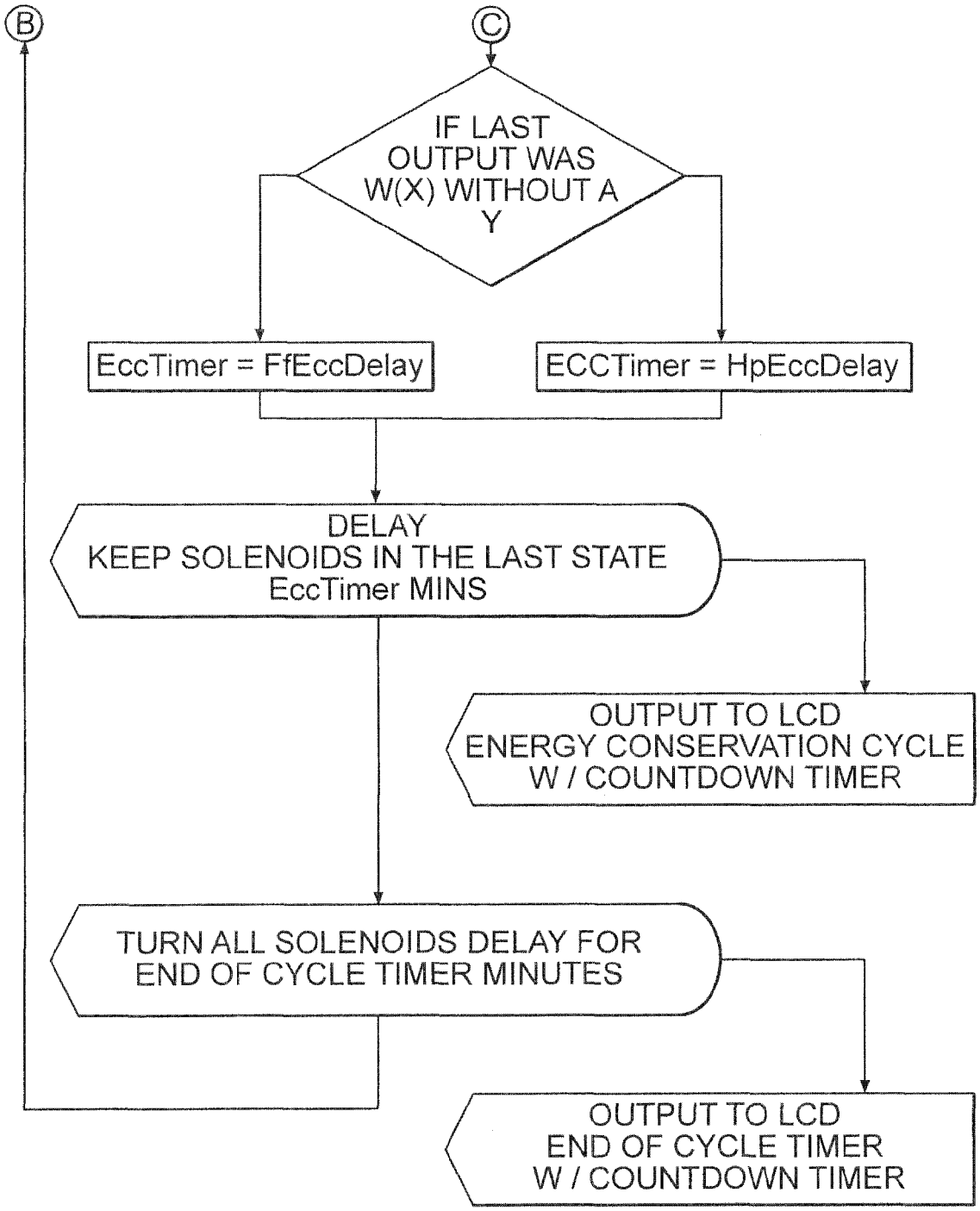

FIGS. 12*a*-12*b* illustrate a flowchart of an exemplary embodiment of a method 1200 of solenoid operation on the control panel 110 of the system 100, in accordance with various aspects of the present invention. In accordance with an embodiment of the present invention, the solenoids of the control panel 110 are controlled by 24 VDC. The electronic controller 115 provides sufficient power to drive six solenoids. Solenoids which are used to open and close air dampers are High (24 VDC) when the dampers are to be closed and Low (0 VDC) when the dampers are to be opened. When the electronic controller 115 is idle, all solenoids are off (0 VDC).

Figure 13A:
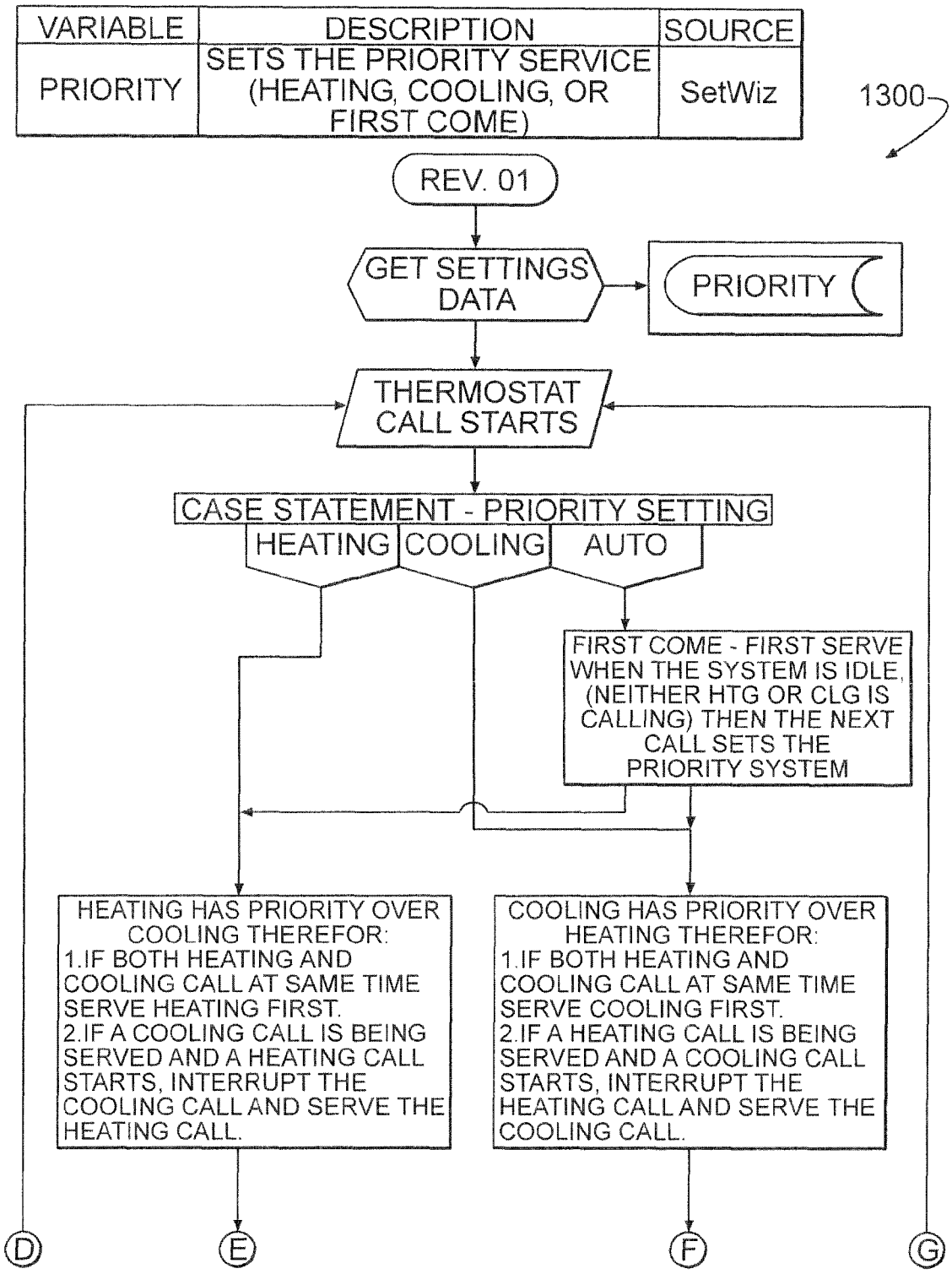
FIGS. 13*a*-13*b* illustrate a flowchart of an exemplary embodiment of a method of a priority select function, in accordance with various aspects of the present invention.
Figure 13B:
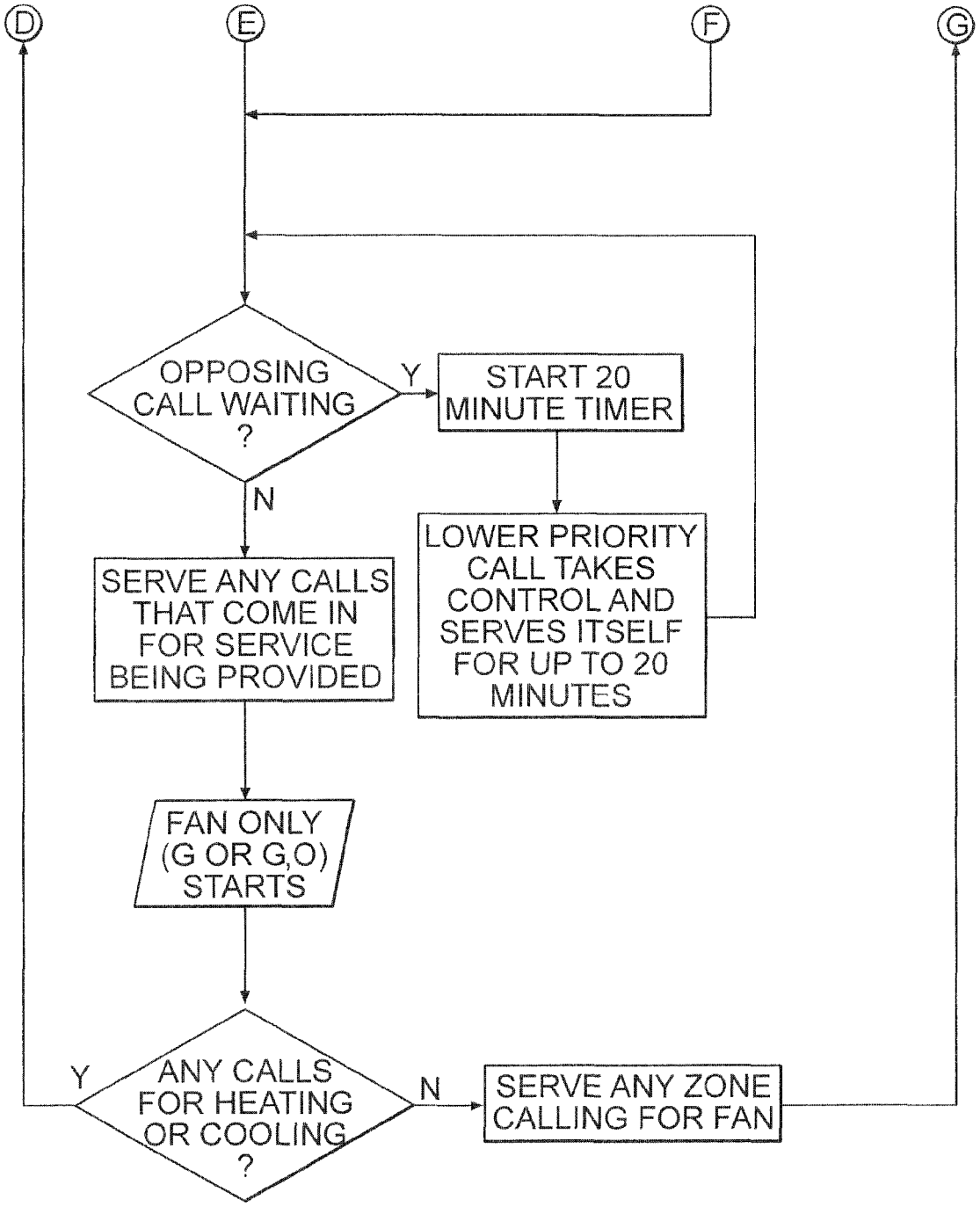

FIGS. 13*a*-13*b* illustrate a flowchart of an exemplary embodiment of a method 1300 of a priority select function, in accordance with various aspects of the present invention. The priority select function determines the priority given to heating, cooling, and fan-only calls based on the current circumstances (e.g., current zone service calls). For example, when "heating" has priority, heating calls have priority over cooling and fan calls. Heating calls interrupt any lower priority calls and a purge cycle commences immediately (as described later herein). Upon completion of the purge cycle, the electronic controller 115 serves the heating call. Any other zone that calls for heating may have it. When "cooling" has priority, cooling calls have priority over heating and fan calls. Cooling calls interrupt any lower priority calls and the purge cycle commences immediately. Upon completion of the purge cycle, the electronic controller serves the cooling call. Any other zone that calls for cooling may have it. In the "Auto" or "First Come, First Served" mode, the call (either heating or cooling) currently being served has priority over any other calls. The current call is not interrupted. The fan is always a lower priority than heating or cooling. In accordance with an embodiment of the present invention, if a non-priority call (heating or cooling) waits for 20 minutes, this call will take control and serve itself for up to 20 minutes. This is to preclude orphan zones (i.e., some zones never being served).

Figure 14A:
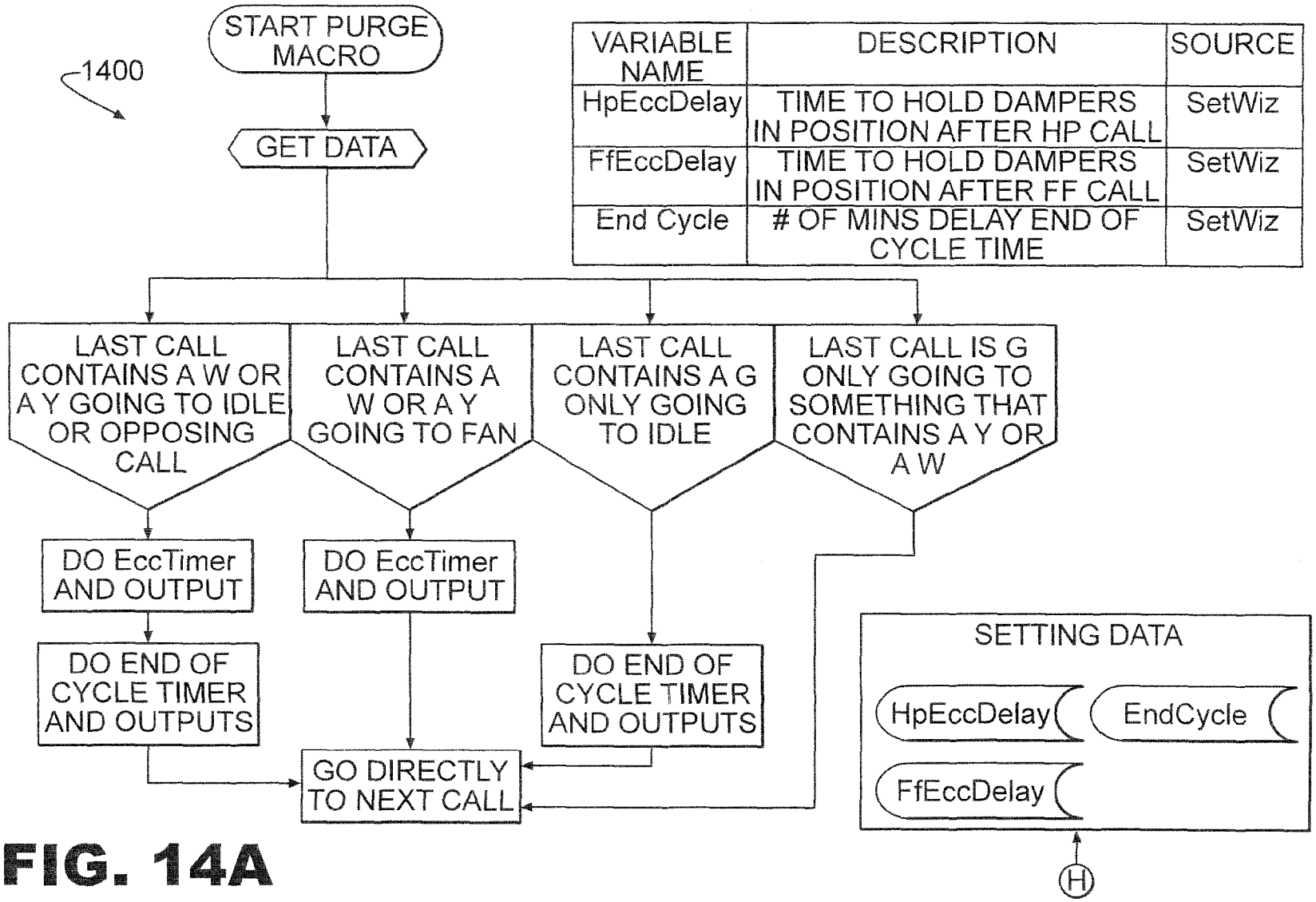
FIGS. 14*a*-14*c* illustrate flowcharts of an exemplary embodiment of methods for performing end of cycle purges, in accordance with various aspects of the present invention.
Figure 14B:
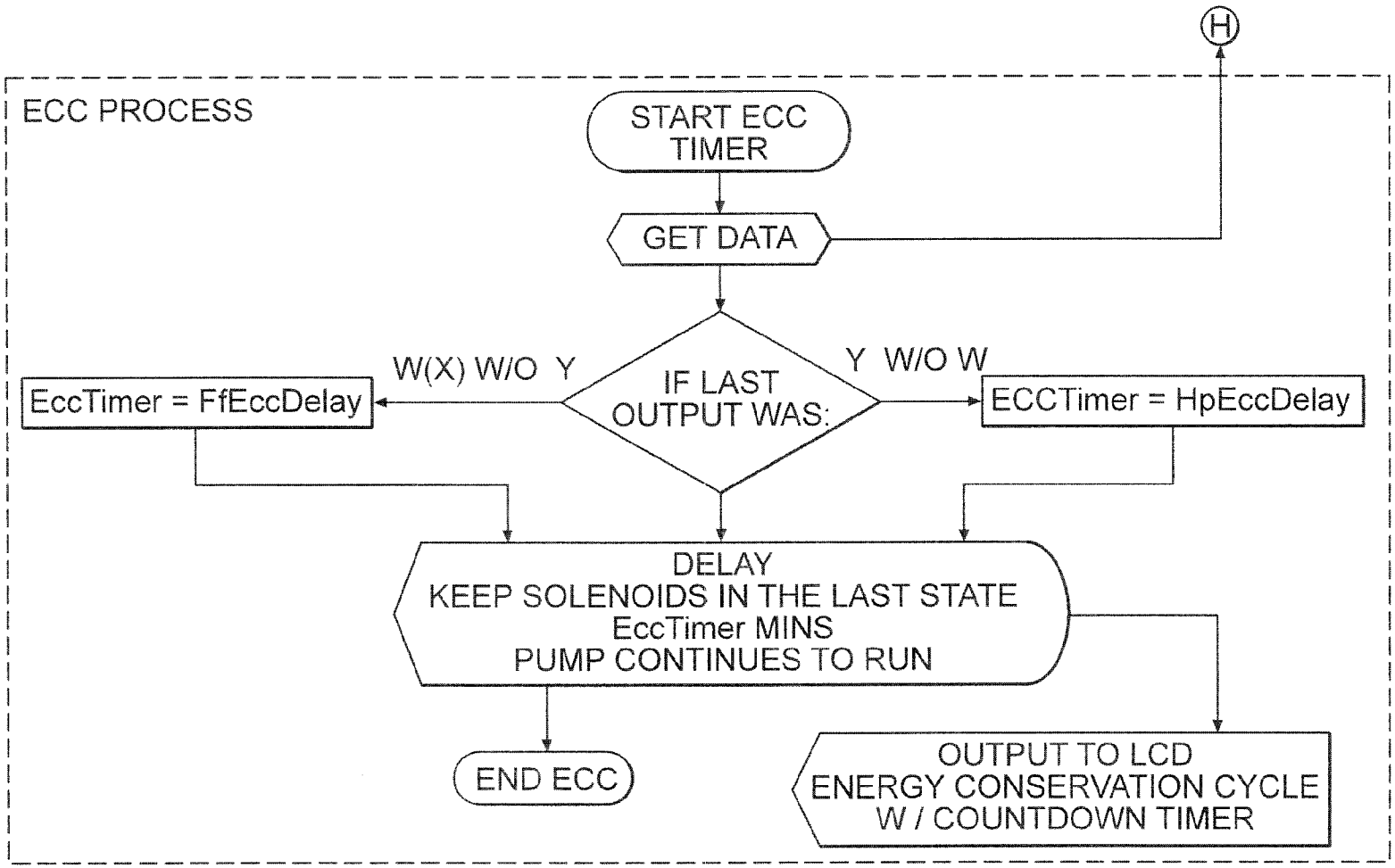
Figure 14C:
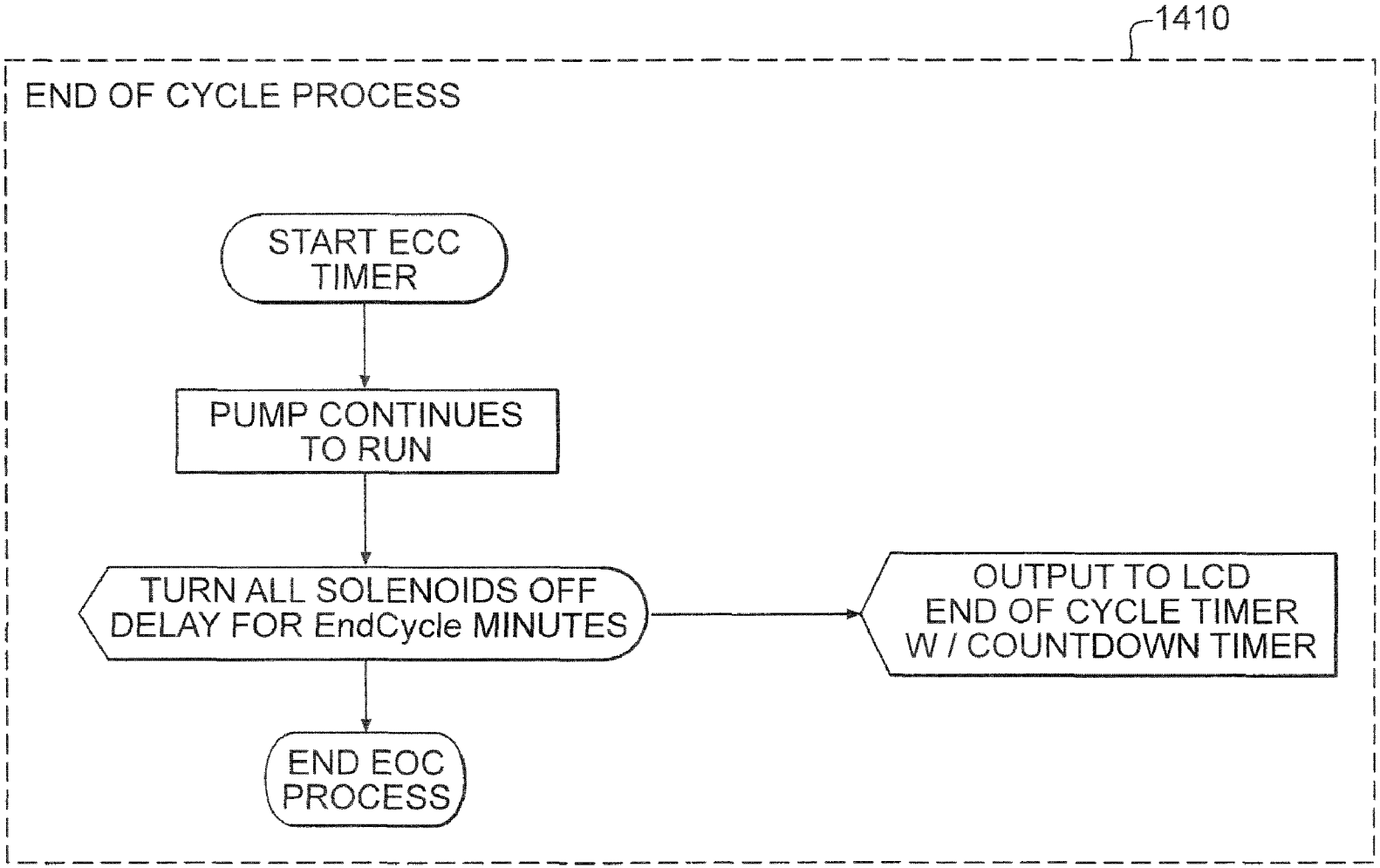

FIGS. 14*a*-14*c* illustrate flowcharts of an exemplary embodiment of methods 1400 and 1410 for performing end of cycle purges, in accordance with various aspects of the present invention. At the end of calls which contain a "Y" (primary heating/cooling source), turn off all solenoids and run the air pump device 170 for one minute. Then run the pre-cycle timer for a length of time previously set up by the operator. At the end of calls that contain a "W" (auxiliary heating/cooling source), hold the dampers in position for two minutes, then turn off all of the solenoids and run the air pump device 170 for the duration of the End-of-Cycle timer. The End-of-Cycle time is the amount of time that the air pump device 170 will run at the conclusion of a call and any purge cycle to open the dampers in preparation for the next call and is adjustable for zero to three minutes. If there is a fan call waiting, allow the fan to continue running during the post-purge and any end-of-cycle damper timing.

Figure 15A:
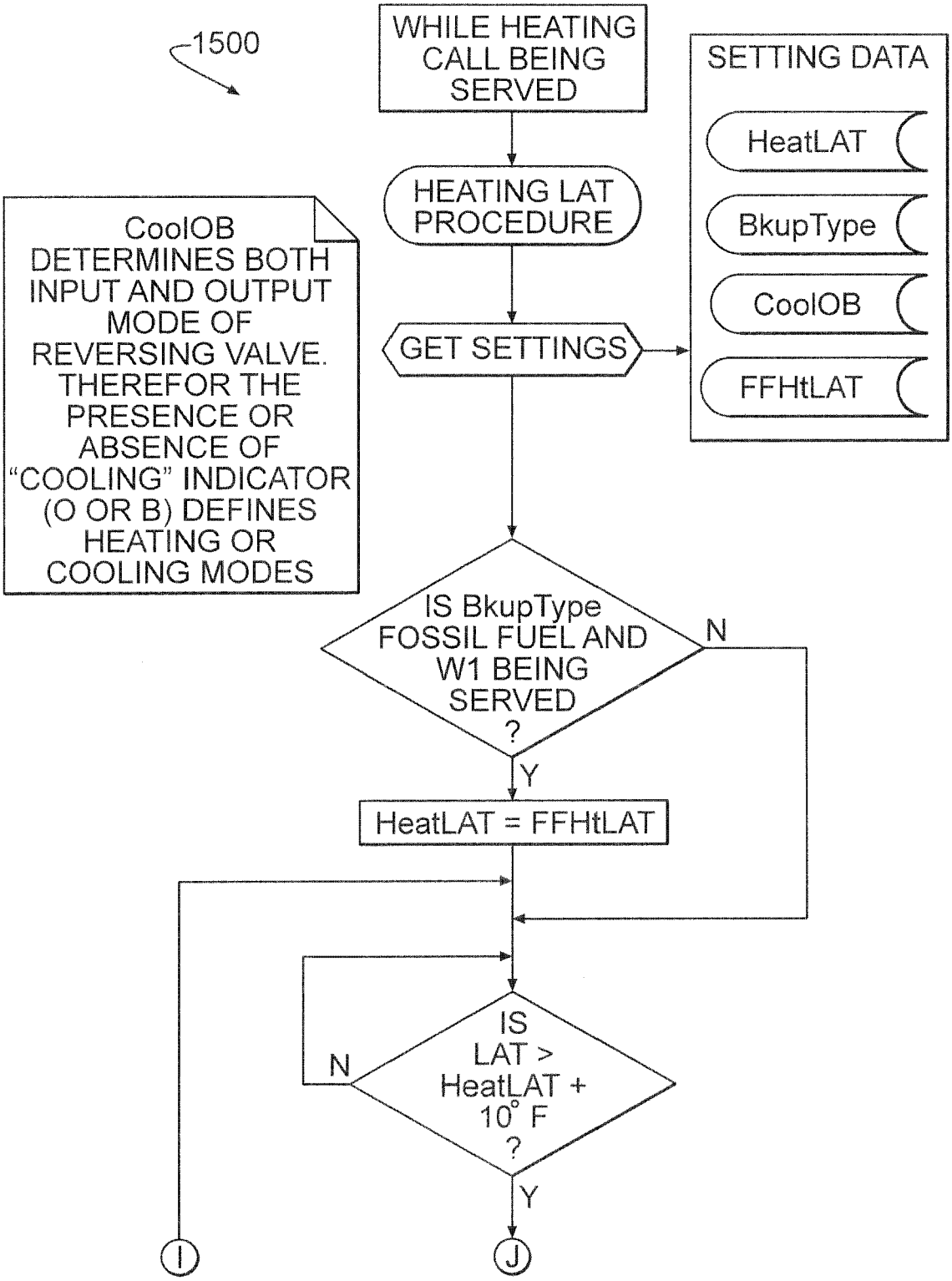
FIGS. 15*a*-15*c* illustrate a flowchart of an exemplary embodiment of a method for performing a heating LAT procedure, in accordance with various aspects of the present invention.
Figure 15B:
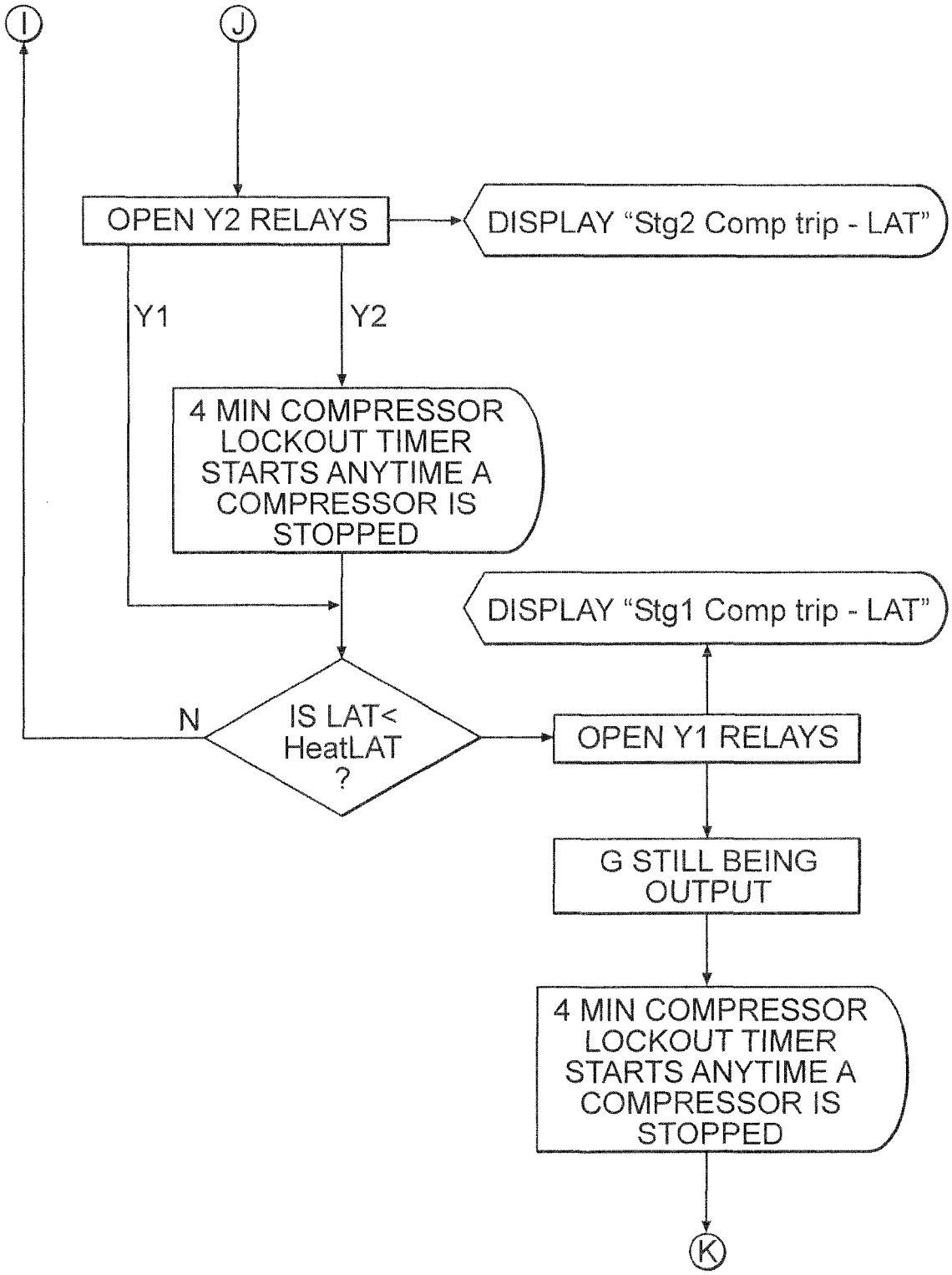
Figure 15C:
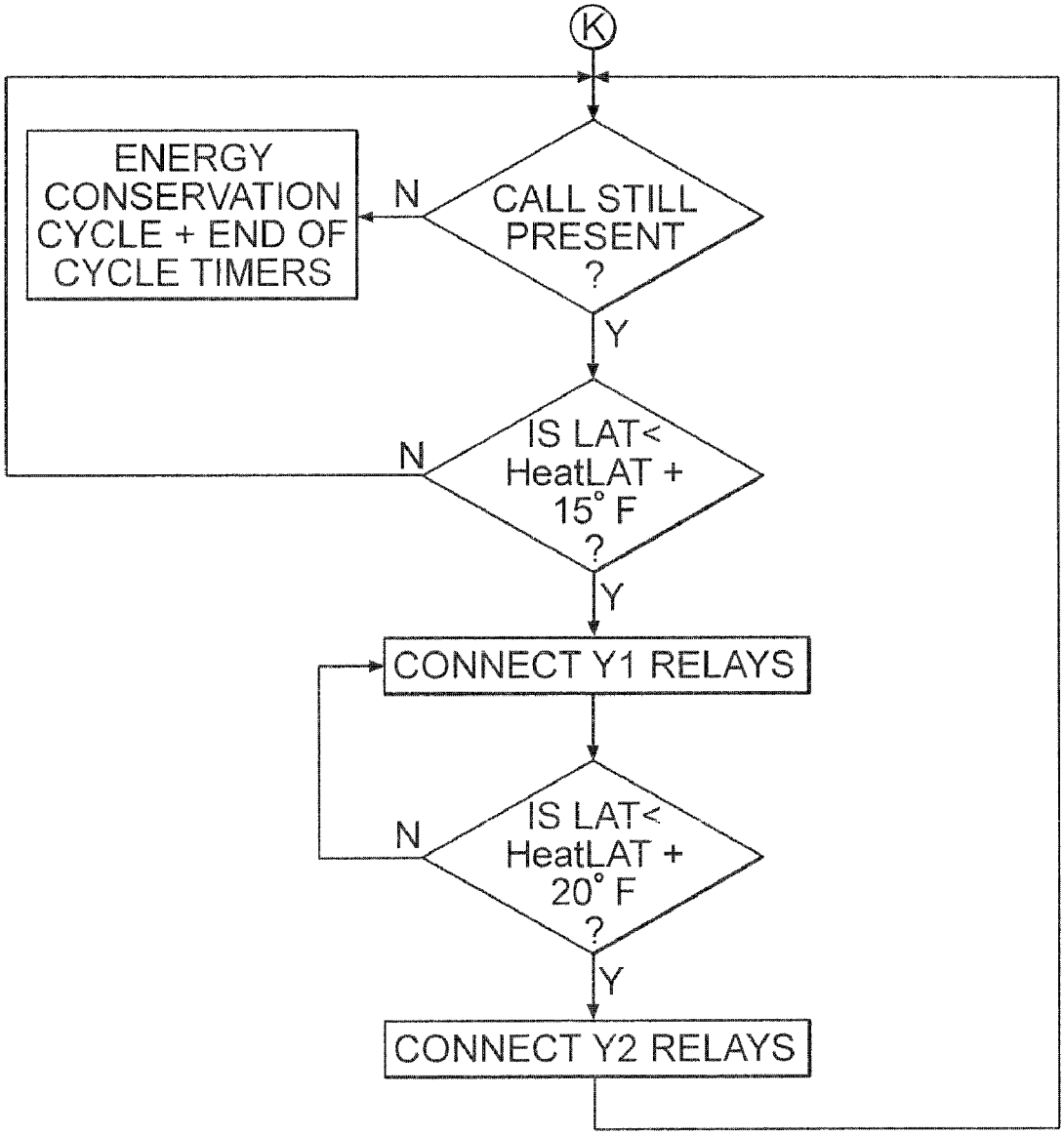

FIGS. 15*a*-15*c* illustrate a flowchart of an exemplary embodiment of a method 1500 for performing a heating LAT procedure, in accordance with various aspects of the present invention. While in the heating mode with the heat pump being served, if the LAT rises above the heating LAT setting minus 10 degrees F., then open the relays associated with Y2(hp) second stage signal to the condenser, and Y2(ah) second stage signal to the furnace/air handler. Also, if the LAT rises above the heating LAT setting, then open the relays associated with Y1(hp) first stage signal to the condenser, and Y1(ah) first stage signal to the furnace/air handler. While in the heating mode with auxiliary equipment (e.g., a furnace) being served, if the LAT rises above the heating LAT setting minus 10 degrees F., then open the relay associated with the W2 second stage auxiliary or backup heat. Also, if the LAT rises above the heating LAT setting, then open the relay associated with the W1 first stage auxiliary or backup heat. The method 1500 is part of the heating method 2300 of FIGS. 23*a*-23*c*.

Figure 16:
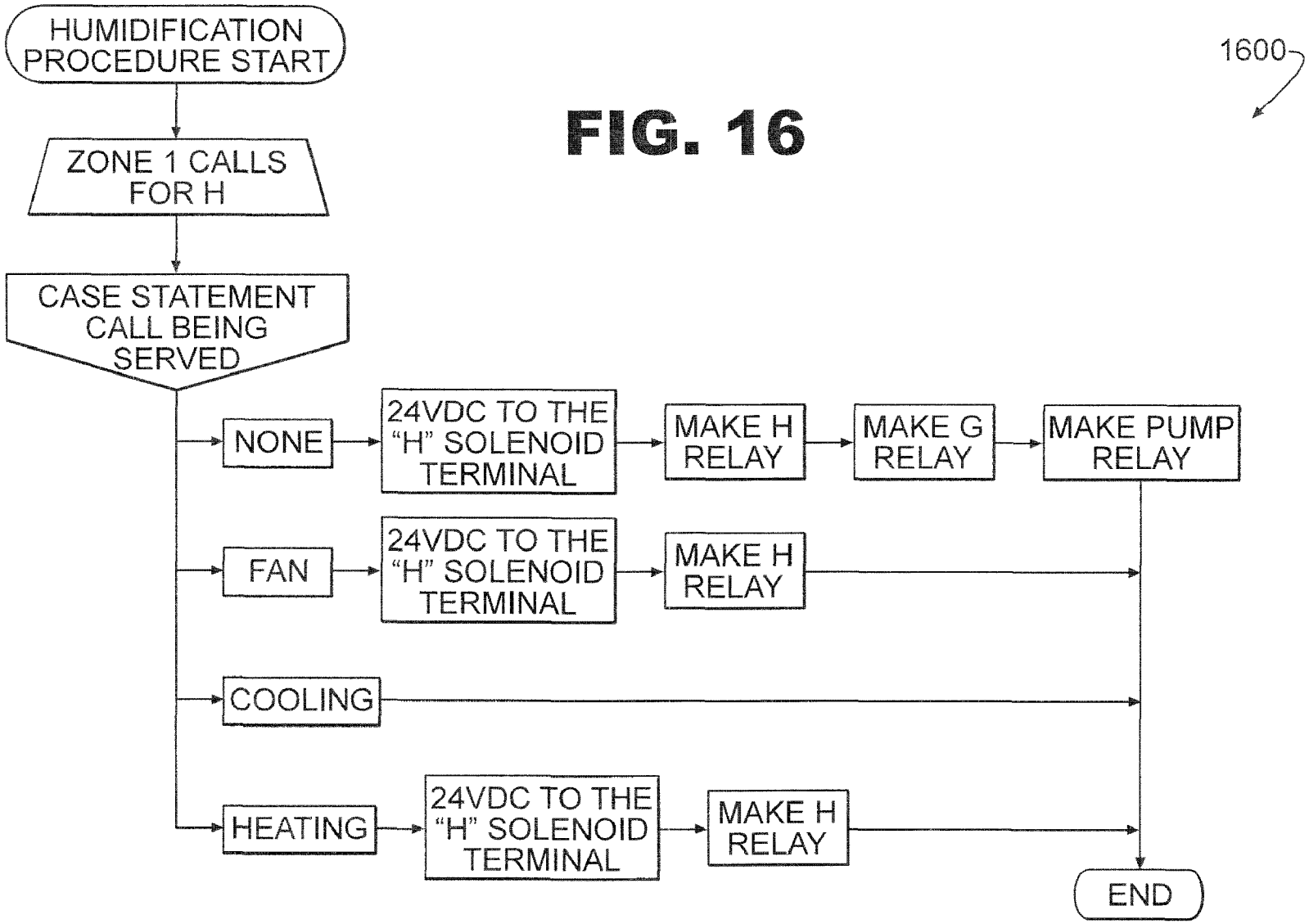
FIG. 16 illustrates a flowchart of an exemplary embodiment of a method for performing a humidification procedure, in accordance with various aspects of the present invention.

FIG. 16 illustrates a flowchart of an exemplary embodiment of a method 1600 for performing a humidification procedure, in accordance with various aspects of the present invention. In accordance with an embodiment of the present invention, zone 1 will have an "H" terminal on the electronic controller 115 for humidification calls which is for powered humidifiers. Any time there is an "H" call, it will pass directly to the "H" output relay regardless of anything else that is happening on the electronic controller 115. There is also an "H" 24 VDS terminal that goes hot when the "H" output terminal goes hot. This allows humidify calls to be handled from any source. A DC terminal provides for a humidifier damper and also provides a flexible built-in auxiliary relay for use in custom operations sequences.

For a de-humidification call, if the electronic controller 115 is currently serving a cooling call, then the electronic controller will turn off the highest stage of the air handler 130. If the electronic controller is idle (not presently serving a call), then when a de-humidification call is received, the electronic controller 115 will activate a first cooling stage of the heat pump 120 and a first stage of the air handler 130 with all dampers open and run for X minutes on and X minutes off where X is pre-defined during setup. In general, the humidity in the air may be decreased by slowing down the fan speed of the air handler 130 on a call for dehumidification from a thermidistat or other humidity monitoring controls. By slowing down the fan, the air is given more contact time with the coil allowing more water to be condensed out of the air.

Figure 17:
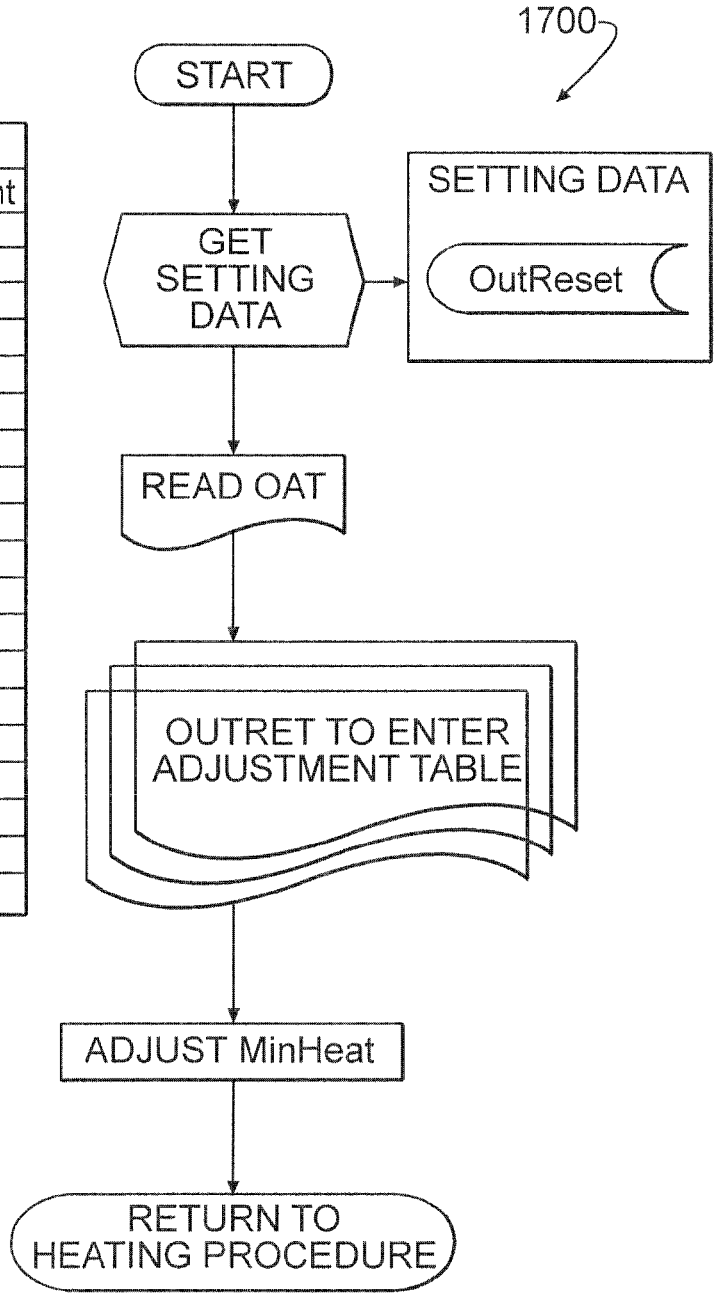
FIG. 17 illustrates a flowchart of an exemplary embodiment of a method for performing outside reset calculations, in accordance with various aspects of the present invention.
Figure 18:
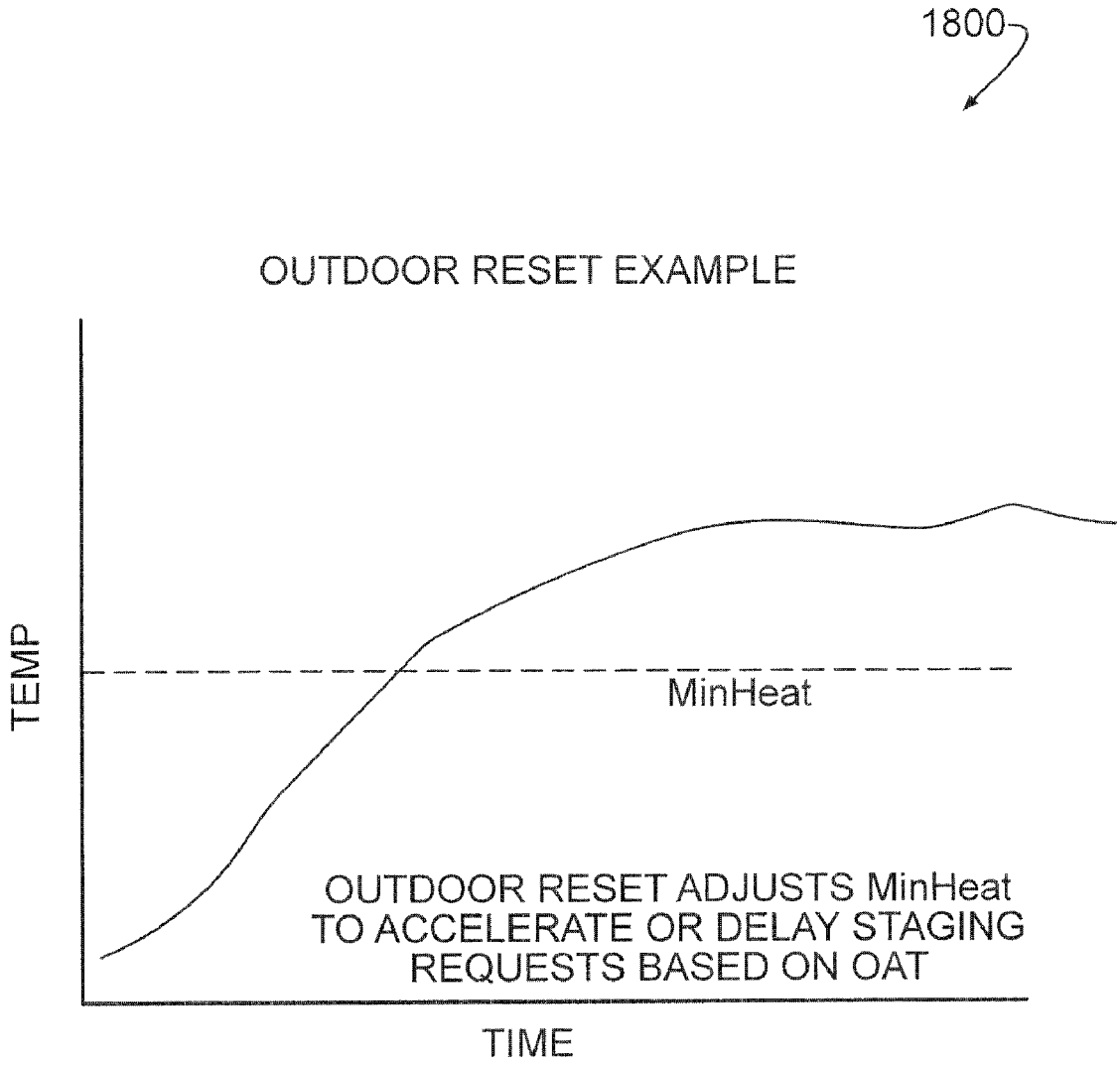
FIG. 18 illustrates a graph of an outdoor reset example using the method of FIG. 17, in accordance with an embodiment of the present invention.

FIG. 17 illustrates a flowchart of an exemplary embodiment of a method 1700 for performing outside reset calculations, in accordance with various aspects of the present invention. The outside reset method 1700 adjusts a minimum heat threshold to accelerate or delay staging requests based on OAT (outside air temperature). FIG. 18 illustrates a graph 1800 of an outdoor reset example using the method 1700 of FIG. 17, in accordance with an embodiment of the present invention.

FIG. 19 illustrates a flowchart of an exemplary embodiment of a method 1900 for performing a cooling stage-up procedure, in accordance with various aspects of the present invention. The method 1900 checks for current stage operation and compares LAT to a threshold value to determine whether or not to stage up during a cooling cycle. The cooling stage-up procedure is a part of the cooling procedure of FIGS. 20*a*-20*b*.

Figure 20A:
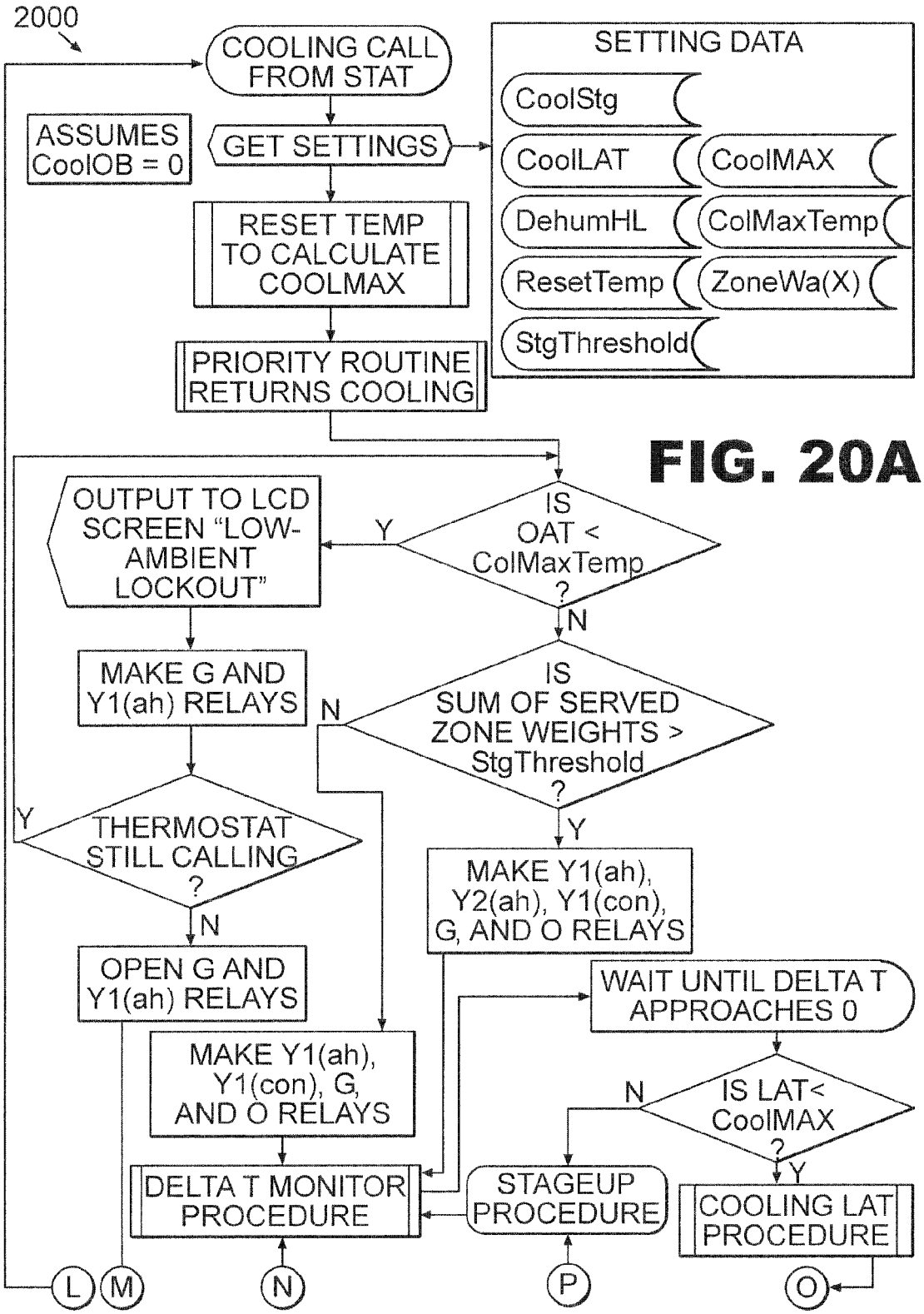

FIGS. 20*a*-20*b* illustrate a flowchart of an exemplary embodiment of a method 2000 for performing a cooling procedure, in accordance with various aspects of the present invention. The method 2000 takes into account OAT, LAT, ΔT, zone service calls, the cumulative weighting value, and other parameters as part of providing cooling to the calling zones in an efficient manner.

Figure 21A:
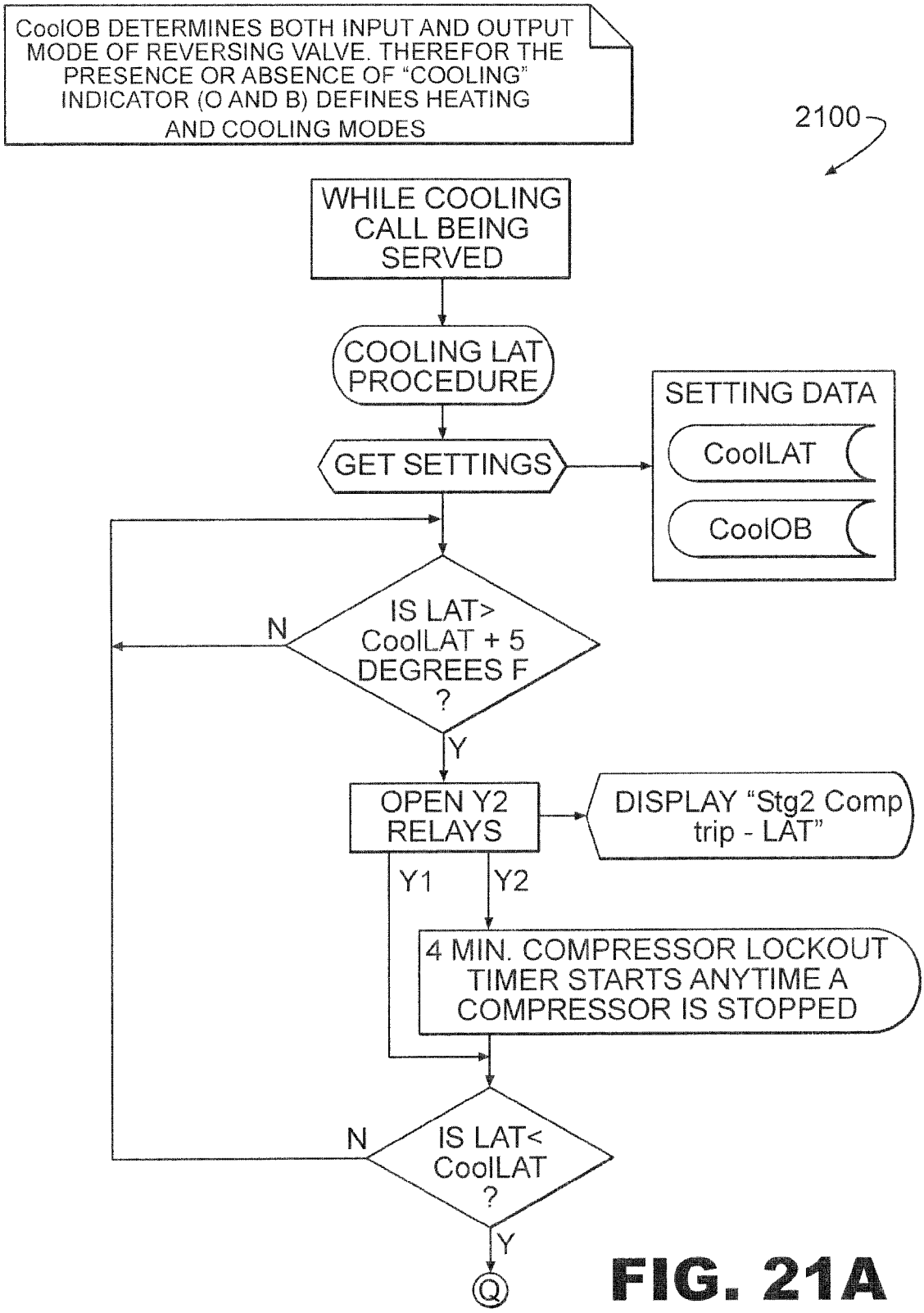
FIGS. 21*a*-21*b* illustrate a flowchart of an exemplary embodiment of a method for performing a cooling LAT procedure, in accordance with various aspects of the present invention.
Figure 21B:
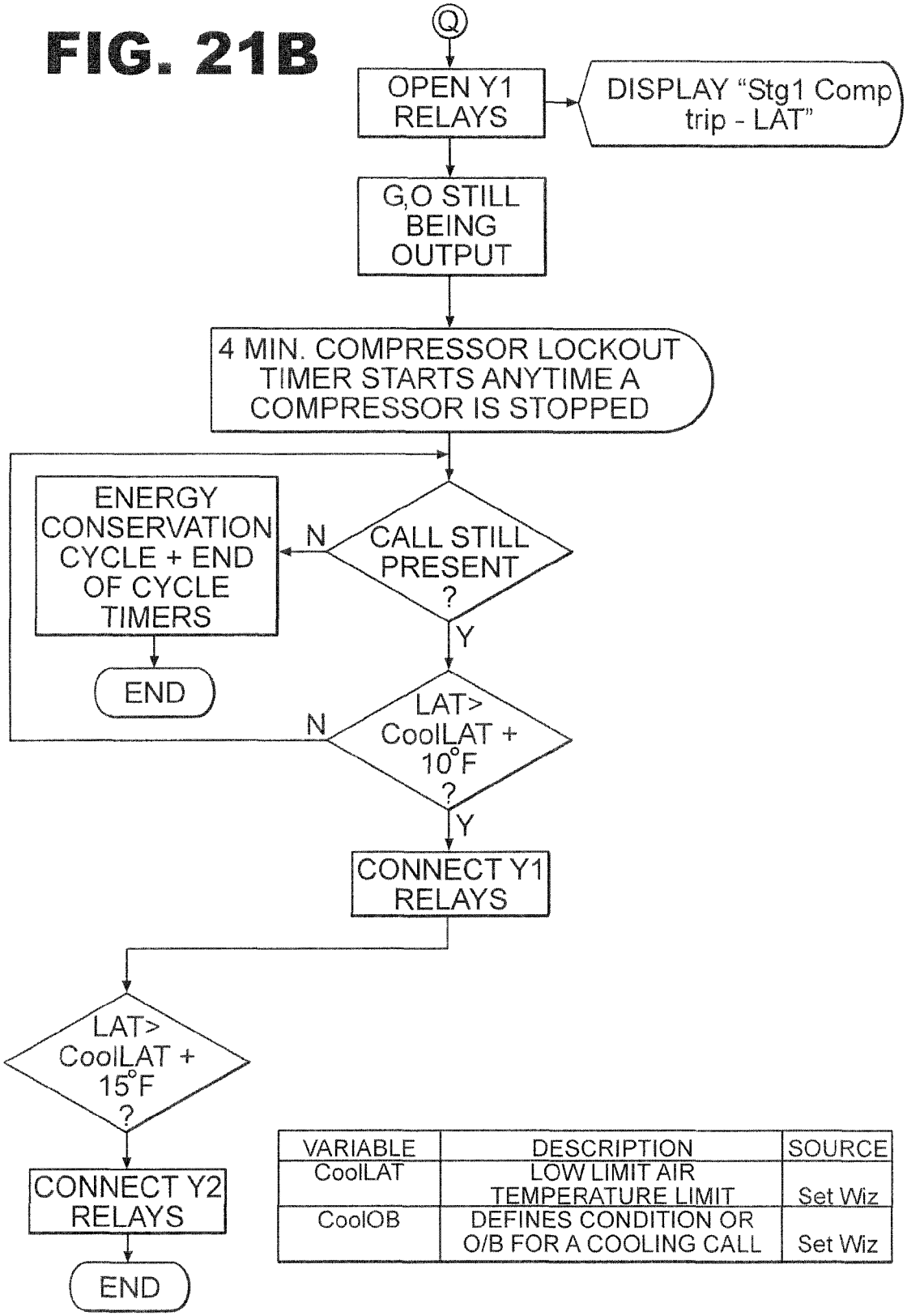

FIGS. 21*a*-21*b* illustrate a flowchart of an exemplary embodiment of a method 2100 for performing a cooling LAT procedure, in accordance with various aspects of the present invention. The method 2100 is a part of the cooling method 2000 of FIGS. 20*a*-20*b*. While in the cooling mode, if the LAT drops below the cooling LAT setting plus 5 degrees F., then the relays associated with the Y2(hp) second stage cooling signal to the condenser and the Y2(ah) second stage cooling signal to the furnace/air handler are opened. If the LAT drops below the cooling LAT setting, then the relays associated with the Y1(hp) first stage cooling signal to the condenser and the Y1(ah) first stage cooling signal to the furnace/air handler are opened.

Figure 22:
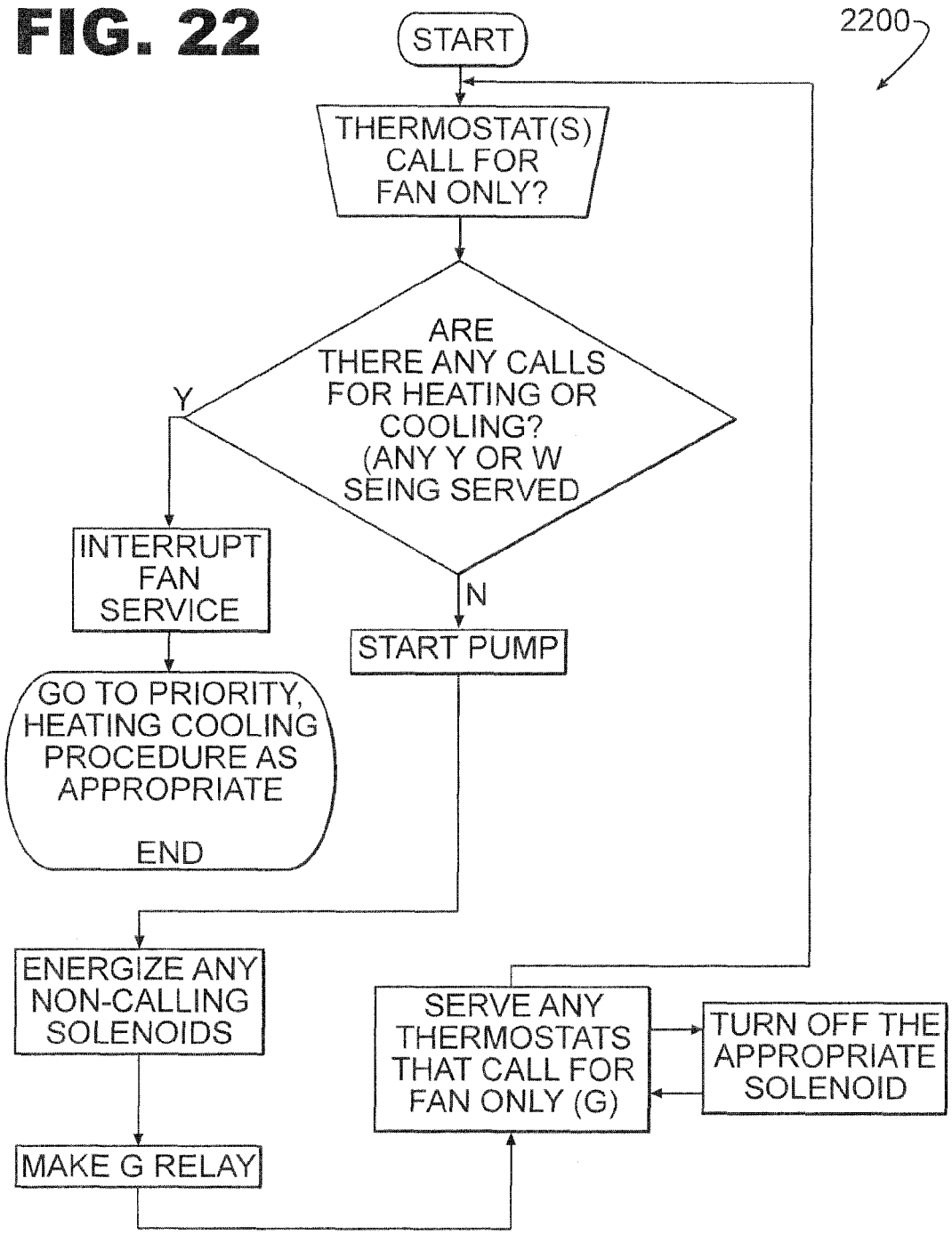
FIG. 22 illustrates a flowchart of an exemplary embodiment of a method for performing fan-only operations, in accordance with various aspects of the present invention.

FIG. 22 illustrates a flowchart of an exemplary embodiment of a method 2200 for performing fan-only operations, in accordance with various aspects of the present invention. In this method 2200, the fan is activated for blowing air to the appropriate calling zones. No heating or cooling is being performed.

Figure 23A:
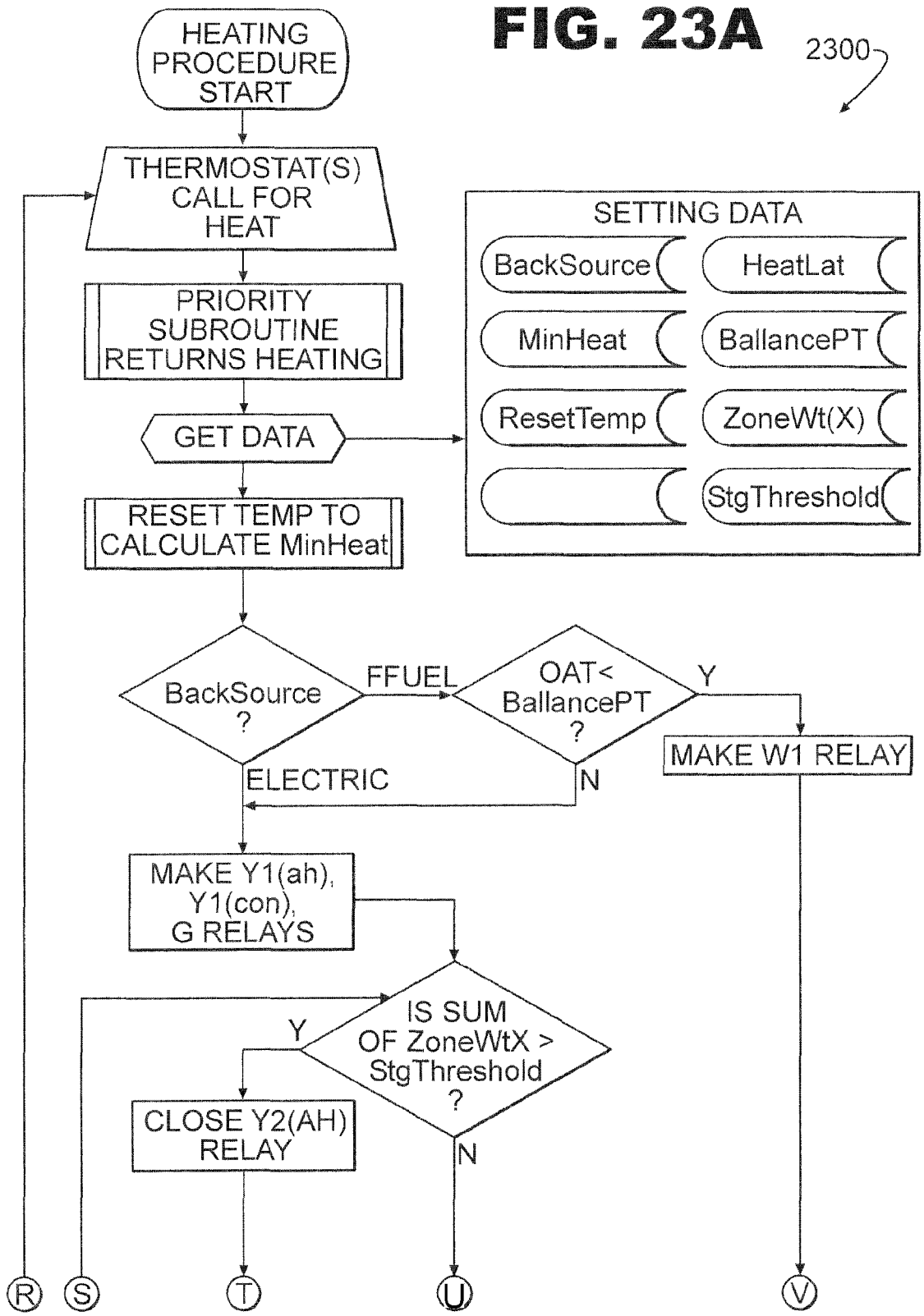
Figure 23B:
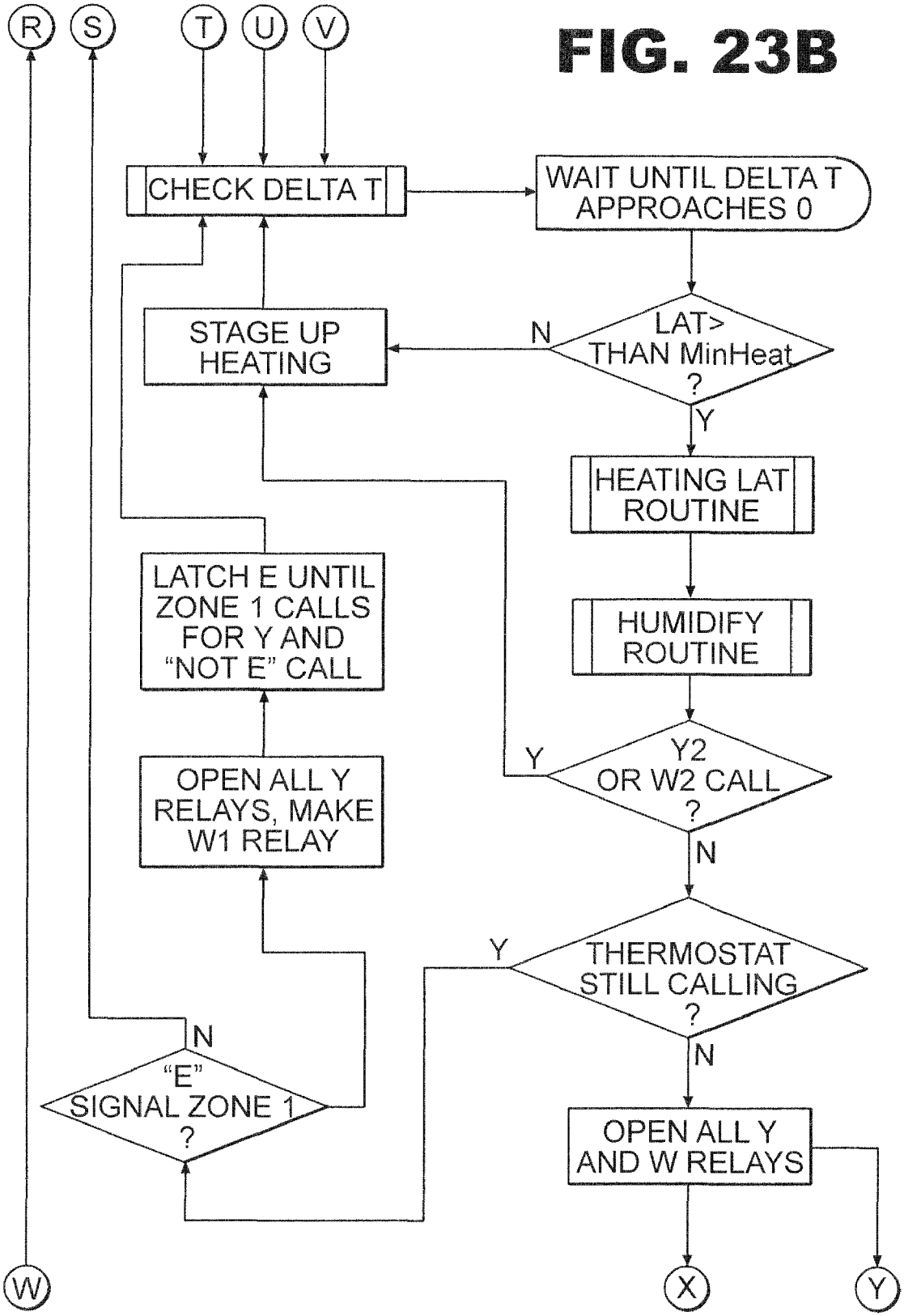

FIGS. 23*a*-23*c* illustrate a flowchart of an exemplary embodiment of a method 2300 for performing a heating procedure, in accordance with various aspects of the present invention. The method 2300 takes into account OAT, LAT, ΔT, zone service calls, the cumulative weighting value, and other parameters as part of providing heating to the calling zones in an efficient manner.

Figure 24A:
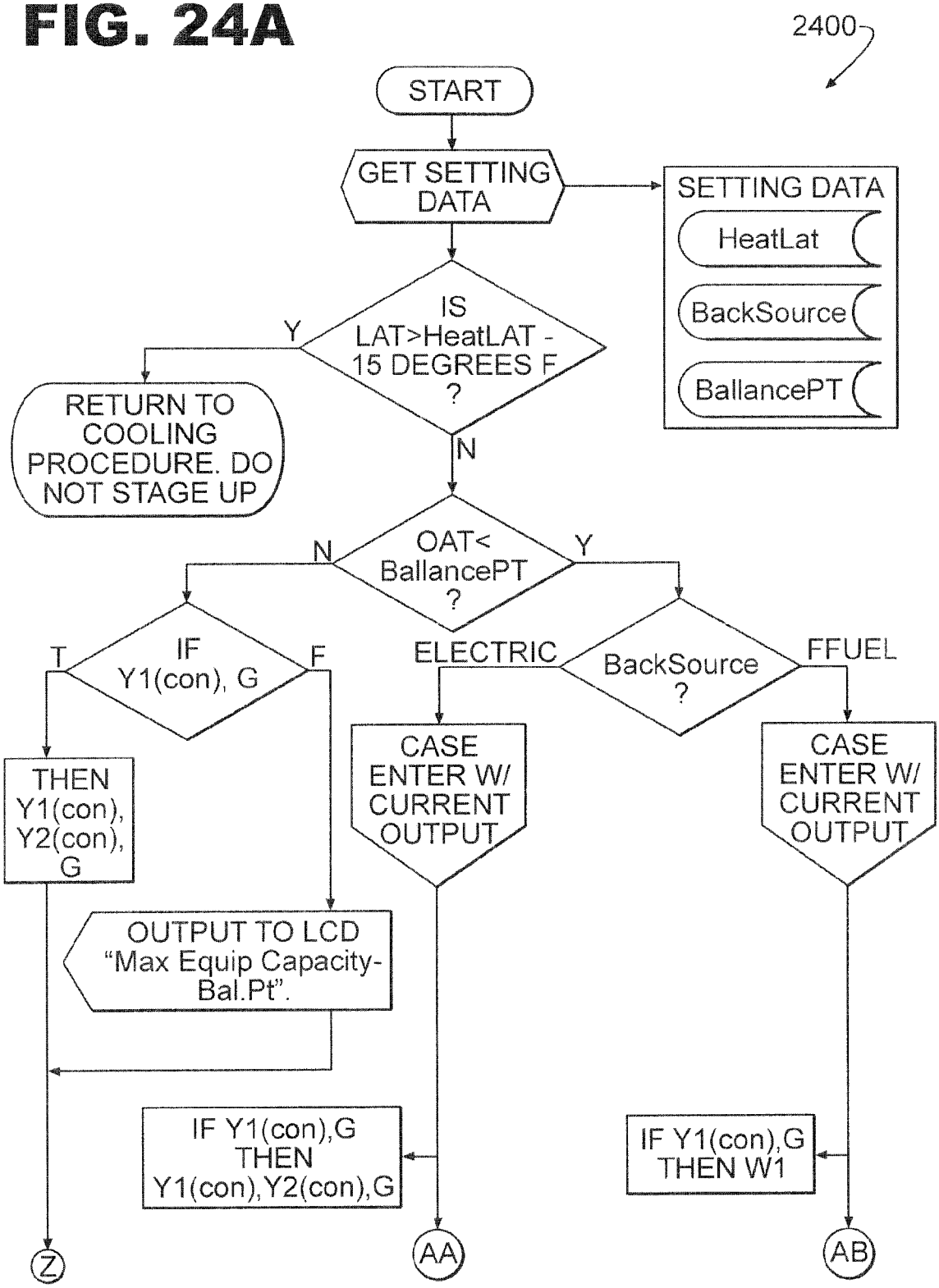
FIGS. 24*a*-24*b* illustrate a flowchart of an exemplary embodiment of a method for performing a heating stage-up procedure, in accordance with various aspects of the present invention.
Figure 24B:
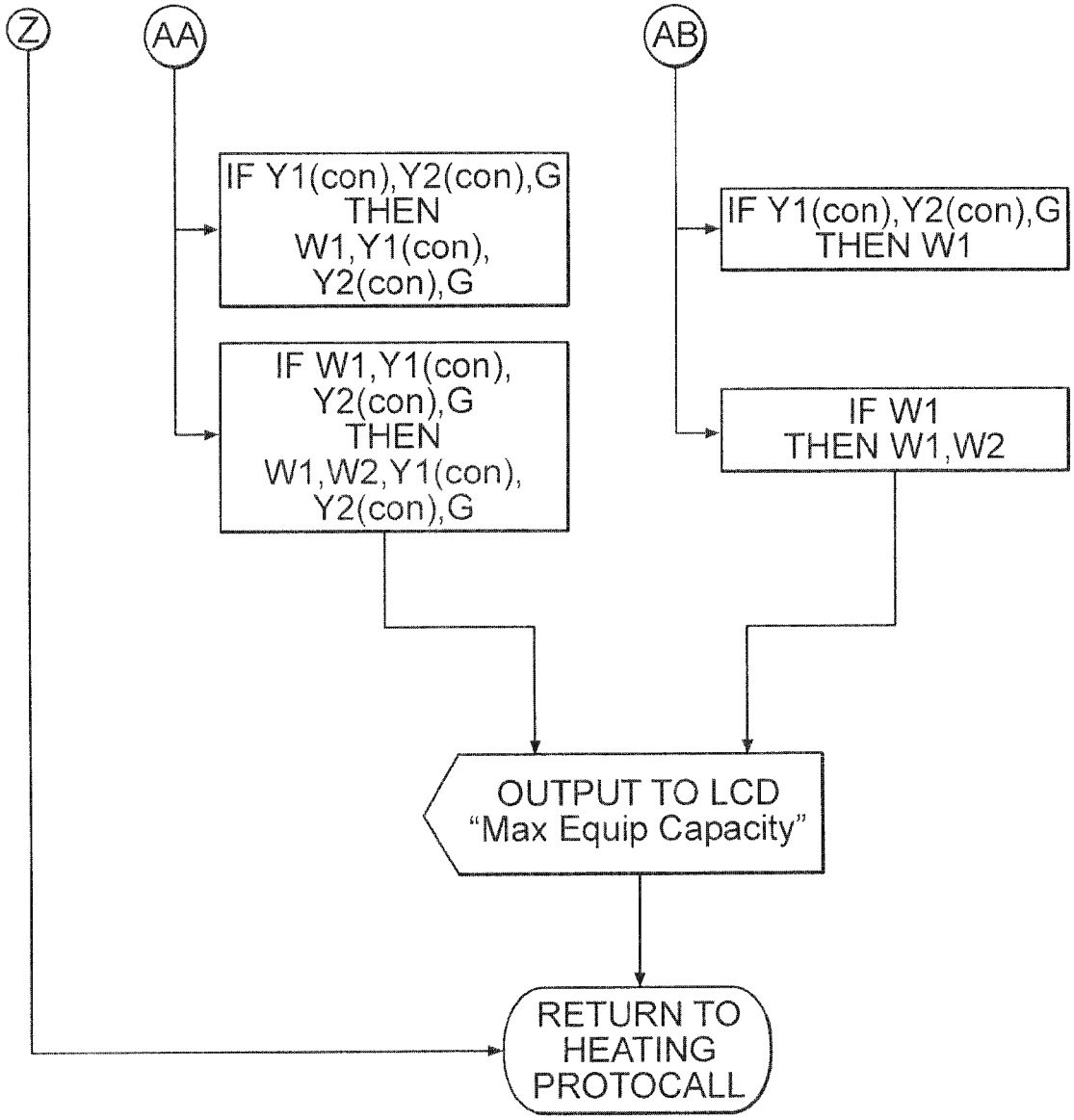

FIGS. 24*a*-24*b* illustrate a flowchart of an exemplary embodiment of a method 2400 for performing a heating stage-up procedure, in accordance with various aspects of the present invention. The method 2400 checks for current stage operation and compares LAT to a threshold value and OAT to a threshold value to determine whether or not to stage up during a heating cycle. The method 2400 is a part of the method 2300 of FIGS. 23*a*-23*c*.

In summary, a system and method to control environmental parameters of pre-defined zones within an environment using an electronic controller are disclosed. Weighting values are assigned, via the electronic controller, to each of the predefined zones and zone service calls are detected, via the electronic controller, from sensor devices associated with each of the zones. A cumulative zone weighting value is determined in response to the zone service calls and a staging combination is selected in response to at least the cumulative zone weighting value.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A method to control environmental parameters of pre-defined zones within a first environment using an electronic controller, said method comprising:

assigning a weighting value to each of said pre-defined zones within said environment using said electronic controller;

detecting any zone service calls from sensor devices associated with each of said pre-defined zones using said electronic controller;

determining a cumulative zone weighting value in response to said detected zone service calls using said electronic controller;

selecting a heat pump and gas furnace staging combination based on at least a change (ΔT) in a leaving air temperature (LAT) of an air handler; and activating said selected heat pump and gas furnace staging combination for heating of at least a portion of said environment using signals provided by said electronic controller.

2. The method of claim 1 wherein said selected heat pump and gas furnace staging combination is selected also in response to an outside air temperature (OAT) of a second environment which is external to said first environment, using said electronic controller.

3. A system to control environmental parameters of pre-defined zones within a first environment, said system comprising:

an electronic controller, wherein said electronic controller is capable of (1) associating an assigned weighting value to each of said pre-defined zones within said environment;

(2) detecting any zone service calls from sensor devices associated with each of said pre-defined zones;

(3) determining a cumulative zone weighting value in response to said sensed zone service calls;

(4) selecting a heat pump and gas furnace staging combination based on at least a change (ΔT) in a leaving air temperature (LAT) of an air handler; and (5) activating said selected heat pump and gas furnace staging combination for heating of at least a portion of said environment using signals provided by said electronic controller.

4. The system of claim 3 wherein said selected heat pump and gas furnace staging combination is selected by said electronic controller also in response to an outside air temperature (OAT) of a second environment which is external to said first environment.

5. The system of claim 3 wherein said electronic controller includes a display device to aid an operator in manually selecting setting options which are pre-programmed into said electronic controller.

6. The system of claim 3 wherein said electronic controller includes a USB port for interfacing to a personal computer (PC).

7. The system of claim 6 wherein said electronic controller stores a history of operational data which may be read out of said electronic controller to said personal computer (PC) via said USB port.

8. The system of claim 6 wherein a set of default setting options may be reloaded from said personal computer (PC) into said electronic controller via said USB port.

9. A method to control environmental parameters of pre-defined zones within a first environment using an electronic controller, said method comprising:

assigning a weighting value to each of said pre-defined zones within said environment using said electronic controller;

detecting any zone service calls from sensor devices associated with each of said pre-defined zones using said electronic controller;

determining a cumulative zone weighting value in response to said detected zone service calls using said electronic controller;

selecting a heat pump and propane heater staging combination based on at least a change (ΔT) in a leaving air temperature (LAT) of an air handler; and activating said selected heat pump and propane heater staging combination for heating of at least a portion of said environment using signals provided by said electronic controller.

10. A system to control environmental parameters of pre-defined zones within a first environment, said system comprising:

an electronic controller, wherein said electronic controller is capable of (1) associating an assigned weighting value to each of said pre-defined zones within said environment;

(2) detecting any zone service calls from sensor devices associated with each of said pre-defined zones;

(3) determining a cumulative zone weighting value in response to said sensed zone service calls;

(4) selecting a heat pump and propane heater staging combination based on at least a change (ΔT) in a leaving air temperature (LAT) of an air handler; and (5) activating said selected heat pump and propane heater staging combination for heating of at least a portion of said environment using signals provided by said electronic controller.

11. A method to control environmental parameters of pre-defined zones within a first environment using an electronic controller, said method comprising:

assigning a weighting value to each of said pre-defined zones within said environment using said electronic controller;

detecting any zone service calls from sensor devices associated with each of said pre-defined zones using said electronic controller;

determining a cumulative zone weighting value in response to said detected zone service calls using said electronic controller;

selecting a heat pump and oil furnace staging combination based on at least a change (ΔT) in a leaving air temperature (LAT) of an air handler; and activating said selected heat pump and oil furnace staging combination for heating of at least a portion of said environment using signals provided by said electronic controller.

12. A system to control environmental parameters of pre-defined zones within a first environment, said system comprising:

an electronic controller, wherein said electronic controller is capable of (1) associating an assigned weighting value to each of said pre-defined zones within said environment;

(2) detecting any zone service calls from sensor devices associated with each of said pre-defined zones;

(3) determining a cumulative zone weighting value in response to said sensed zone service calls;

(4) selecting a heat pump and oil furnace staging combination based on at least a change (ΔT) in a leaving air temperature (LAT) of an air handler; and (5) activating said selected heat pump and oil furnace staging combination for heating of at least a portion of said environment using signals provided by said electronic controller.

13. A method to control environmental parameters of pre-defined zones within a first environment using an electronic controller, said method comprising:

assigning a weighting value to each of said pre-defined zones within said environment using said electronic controller;

detecting any zone service calls from sensor devices associated with each of said pre-defined zones using said electronic controller;

determining a cumulative zone weighting value in response to said detected zone service calls using said electronic controller;

selecting a heat pump and resistive heating strip staging combination based on at least a change (ΔT) in a leaving air temperature (LAT) of an air handler; and activating said selected heat pump and resistive heating strip staging combination for heating of at least a portion of said environment using signals provided by said electronic controller.

14. A system to control environmental parameters of pre-defined zones within a first environment, said system comprising:

an electronic controller, wherein said electronic controller is capable of (1) associating an assigned weighting value to each of said pre-defined zones within said environment;

(2) detecting any zone service calls from sensor devices associated with each of said pre-defined zones;

(3) determining a cumulative zone weighting value in response to said sensed zone service calls;

(4) selecting a heat pump and resistive heating strip staging combination based on at least a change (ΔT) in a leaving air temperature (LAT) of an air handler; and (5) activating said selected heat pump and resistive heating strip staging combination for heating of at least a portion of said environment using signals provided by said electronic controller.

15. A method to control environmental parameters of pre-defined zones within a first environment using an electronic controller, said method comprising:

assigning a weighting value to each of said pre-defined zones within said environment using said electronic controller;

detecting any zone service calls from sensor devices associated with each of said pre-defined zones using said electronic controller;

determining a cumulative zone weighting value in response to said detected zone service calls using said electronic controller;

selecting a heat pump and auxiliary air conditioner staging combination based on at least a change (ΔT) in a leaving air temperature (LAT) of an air handler; and activating said selected heat pump and auxiliary air conditioner staging combination for cooling of at least a portion of said environment using signals provided by said electronic controller.

16. A system to control environmental parameters of pre-defined zones within a first environment, said system comprising:

an electronic controller, wherein said electronic controller is capable of (1) associating an assigned weighting value to each of said pre-defined zones within said environment;

(2) detecting any zone service calls from sensor devices associated with each of said pre-defined zones;

(3) determining a cumulative zone weighting value in response to said sensed zone service calls;

(4) selecting a heat pump and auxiliary air conditioner staging combination based on at least a change (ΔT) in a leaving air temperature (LAT) of an air handler; and (5) activating said selected heat pump and auxiliary air conditioner staging combination for cooling of at least a portion of said environment using signals provided by said electronic controller.

* * * * *